US008398078B2

(12) United States Patent
Kotani

(10) Patent No.: US 8,398,078 B2
(45) Date of Patent: Mar. 19, 2013

(54) POST-PROCESSING DEVICE AND IMAGE FORMING APPARATUS INCLUDING THE SAME

(75) Inventor: Takashi Kotani, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/191,797

(22) Filed: Jul. 27, 2011

(65) Prior Publication Data

US 2012/0025443 A1 Feb. 2, 2012

(30) Foreign Application Priority Data

Jul. 29, 2010 (JP) ..... 2010-171066

(51) Int. Cl.
*B65H 31/36* (2006.01)

(52) U.S. Cl. ..... 271/221; 270/58.27

(58) Field of Classification Search ..... 271/240, 271/248, 253, 221; 270/58.12, 58.16, 58.17, 270/58.27, 30.07
See application file for complete search history.

(56) References Cited

U.S. PATENT DOCUMENTS 6,832,759 B2 * 12/2004 Nagasako et al. ..... 271/222

FOREIGN PATENT DOCUMENTS

| | | |
|---|---|---|
| JP | 2001-242563 | 9/2001 |
| JP | 2002-293472 | 10/2002 |
| JP | 2007-022762 | 2/2007 |
| JP | 2009-038787 | 2/2009 |
| JP | 2010-070362 | 4/2010 |

* cited by examiner

*Primary Examiner* — Michael McCullough
(74) *Attorney, Agent, or Firm* — Knobbe, Martens, Olson & Bear, LLP

(57) ABSTRACT

An image forming apparatus includes a sheet aligning mechanism that aligns a sheet of medium stacked by causing the sheet of medium to move in a shift direction orthogonal to a feed direction. The sheet aligning mechanism includes: a pair of alignment members having a pair of alignment surfaces; a rotational waiting position detector that detects whether the alignment members have moved to a rotational waiting position at which the alignment members wait; a rectilinear waiting position detector that detects whether the alignment members have moved to a rectilinear waiting position; and a post-processing controller that performs correction of a rotational angle and amount of movement of the alignment members performed by a rotational movement drive mechanism, based on signals output from the rotational waiting position detector and the rectilinear waiting position detector.

8 Claims, 19 Drawing Sheets

POST-PROCESSING DEVICE AND IMAGE FORMING APPARATUS INCLUDING THE SAME

This application is based on and claims the benefit of priority from Japanese Patent Application No. 2010-171066, filed on 29 Jul. 2010, the content of which is incorporated herein by reference.

BACKGROUND OF THE INVENTION

1. Field of the Invention

The present invention relates to a post-processing device and an image forming apparatus including the same.

2. Related Art

Among conventional image forming apparatuses, there are those that include a post-processing device which performs post-processing on a sheet of medium on which an image has been formed in an image forming apparatus, such as a copy machine and multi-functional machine. Such a post-processing device includes a pair of feed rollers that feeds a sheet of medium in a feed direction so as to be stacked on a tray, and a sheet aligning mechanism that causes the sheet of medium fed from the pair of feed rollers to move in a shift direction (direction orthogonal to the feed direction and a sheet stacking direction), so that the sheet of medium is aligned at a predetermined position on the tray.

For example, a sheet aligning mechanism has been known that causes a pair of alignment members to rotationally and rectilinearly move to be on standby at an alignment waiting position, before causing the sheet of medium fed from the pair of feed rollers to be located between the pair of alignment members. Then, the sheet aligning mechanism causes one alignment member to push the fed sheet of medium in parallel to the shift direction from one alignment waiting position, thereby the one alignment member causing the sheet of medium thus pushed to abut the other alignment member at the alignment waiting position. In this manner, the sheet aligning mechanism performs positioning of the sheet of medium in the shift direction.

Such a sheet aligning mechanism includes the pair of alignment members configured to be rotationally and rectilinearly movable, relative to an alignment axis that has a length greater than a width of the sheet of medium (dimension in the shift direction).

A stepping motor is used in a shift drive portion that causes the pair of alignment members to move in the shift direction, and in a rotational drive portion that causes the pair of alignment members to rotate around a rotation shaft. The stepping motor has extremely high tracking performance to input signals, and thus is controlled by an open loop. Therefore, in order to curb manufacturing costs of image forming apparatuses, detectors to detect positions of the pair of alignment members, which are control objects of the shift drive controller and the rotational drive controller, are rarely built into such image forming apparatuses.

Since the detection of positional information of the pair of alignment members is not carried out, it is likely that the positions of the pair of alignment members may shift from objective positions to be controlled when the sheet of medium stacked on the tray comes in contact with the pair of alignment members under control.

SUMMARY OF THE INVENTION

The present invention provides a post-processing device for which positions of a pair of alignment members do not easily shift from objective positions to be controlled, as well as an image forming apparatus equipped therewith.

A post-processing device of the present invention includes a pair of feed rollers configured to feed a sheet of medium in a feed direction while sandwiching the sheet of medium therebetween, a tray configured to stack the sheet of medium fed by the pair of feed rollers in a stacking direction and a sheet aligning mechanism configured to cause the sheet of medium stacked on the tray to move in a shift direction perpendicular to the feed direction and the stacking direction, such that the sheet of medium is aligned. The sheet aligning mechanism includes a pair of alignment members, an alignment member support, a rotationally and rectilinearly driving mechanism, a rotational waiting position detector, a rectilinear waiting position detector and a post-processing controller. The pair of alignment members includes a pair of alignment surfaces configured to push an end of the sheet of medium in the shift direction. The pair of alignment surfaces extends into a region above the tray in the stacking direction. The alignment member support is configured to support the pair of alignment members such that the pair of alignment members is rotatable about a rotation shaft extending in the shift direction and rectilinearly movable in the shift direction, within a region on a side closer to the sheet of medium stacked on the tray with respect to the stacking direction. The rotationally and rectilinearly driving mechanism is configured to cause the pair of alignment members to rotate about the rotation shaft extending in the shift direction and to rectilinearly move in the shift direction. The rotational waiting position detector is configured to detect whether the pair of alignment members has moved to a rotational waiting position provided for the pair of alignment members. The rotational waiting position is a part of a rotational range in which the pair of alignment members is rotatable about the rotation shaft extending in the shift direction. The rectilinear waiting position detector is configured to detect whether the pair of alignment members has moved to a rectilinear waiting position provided for the pair of alignment members. The rectilinear waiting position is a part of a rectilinear range in which the pair of alignment members is movable in the shift direction. The post-processing controller is configured to cause the rotationally and rectilinearly driving mechanism to correct a rotational angle and an amount of rectilinear movement based on signals sent from the rotational waiting position detector and the rectilinear waiting position detector.

An image forming apparatus according to the present invention includes an image forming main device that forms an image on a sheet of medium, and the aforementioned post-processing device.

According to the present invention, it is possible to provide the post-processing device for which the positions of the pair of alignment members do not easily shift from the objective positions to be controlled, as well as the image forming apparatus equipped therewith.

DETAILED DESCRIPTION OF THE INVENTION

Figure 1:
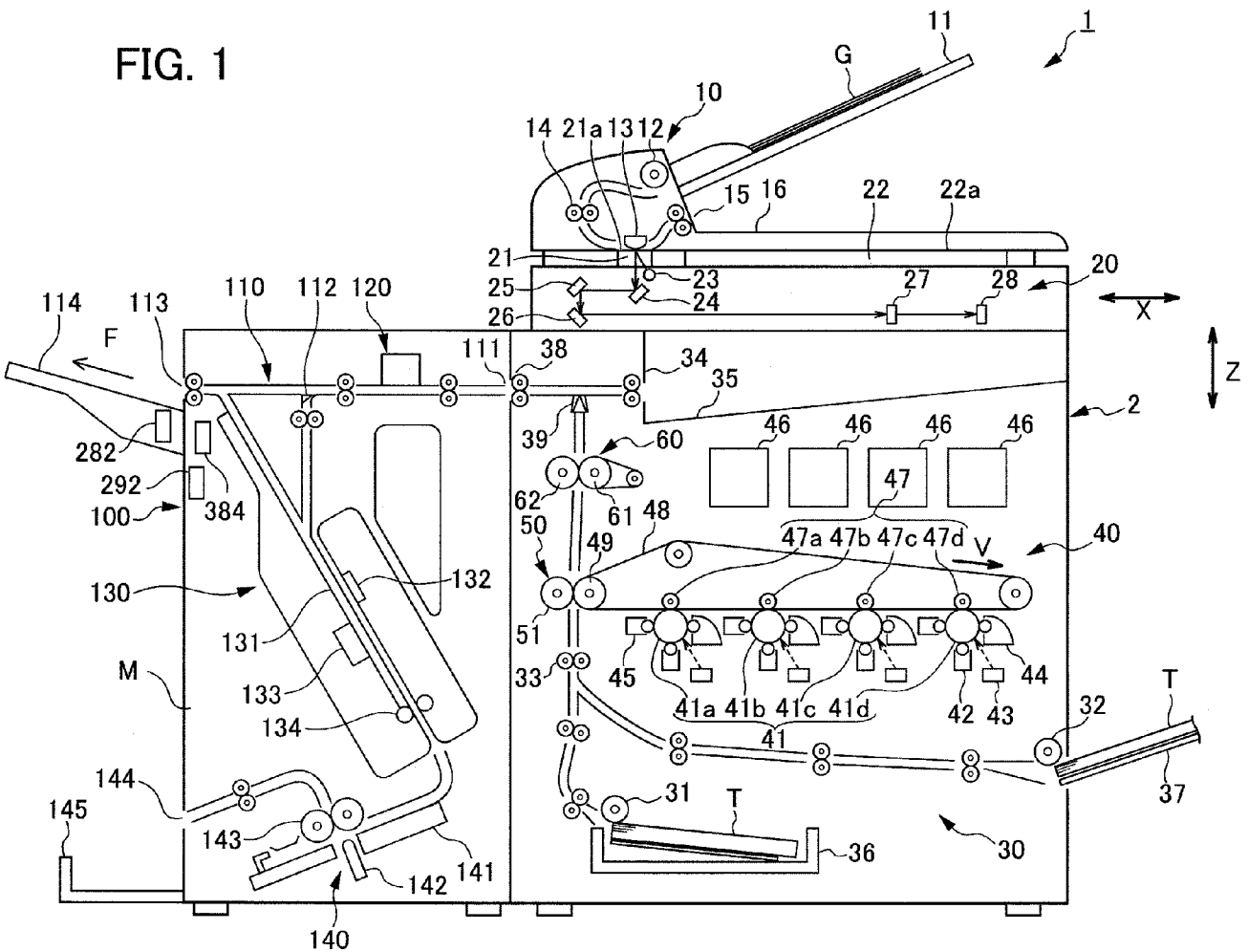
FIG. 1 is a front view of a copy machine 1 as a first embodiment of the present invention.

Hereinafter, a copy machine 1 including a post-processing device 100 will be explained while referring to the drawings as an embodiment of an image forming apparatus of the present invention. First, the overall configuration of the copy machine 1 will be explained. FIG. 1 is a view illustrating the overall configuration of the copy machine 1 according to an embodiment of an image forming apparatus.

Copy Machine 1

The copy machine 1 includes a copy machine main body (image forming main device) 2 that forms a toner image on a sheet of medium T, and the post-processing device 100, which is arranged on a sheet discharging side of the copy machine main body 2, performs punching, stapling, folding and the like on sheets of media T on which toner images have been formed.

In the following explanation, a horizontal direction is defined as a direction of an arrow X, a front-back (depth) direction is defined as a direction of an arrow Y (refer to FIG. 2), and a vertical direction is defined as a direction of an arrow Z, when viewed by a user standing at the front side of the copy machine 1.

The post-processing device 100 will be explained in detail later.

Copy Machine Main Body 2

The copy machine main body 2 includes a document feeding portion 10, document reading portion 20, first sheet feeding portion 30, image forming portion 40, transfer portion 50, and fixing portion 60.

The document feeding portion 10 is an auto document feeder (ADF) and includes a document placement portion 11, first feed roller 12, guide 13, pair of timing rollers 14, and document discharging portion 15. The first feed roller 12 sequentially supplies an original G placed on the document placement portion 11 to the pair of timing rollers 14 one-by-one. The pair of timing rollers 14 performs feeding of the original G or interrupts feeding of the original G, in order to match the timing of the document reading portion 20 reading the original G and the timing of supplying the original G to a position (position at which the guide 13 is arranged) at which the original G is read by the document reading portion 20. The guide 13 leads the fed original G to a first reading surface 21*a* described later. The document discharging portion 15 discharges the original G read by the document reading portion 20 (having passed the guide 13) to outside the copy machine main body 2.

A document collecting portion 16 is formed at the document discharging portion 15 outside the copy machine main body 2. Originals G discharged from the document discharging portion 15 are stacked and collected on the document collecting portion 16.

The document reading portion 20 includes a second reading surface 22*a* as well as the first reading surface 21*a*. The first reading surface 21*a* is formed along a top face of a first contact glass 21 arranged opposite to the guide 13, and serves as a surface on which the original G is read. The second reading surface 22*a* is arranged (as shown in FIG. 1, over a large portion on the right side of the first reading surface 21*a*) adjacent to the first reading surface 21*a*. The second reading surface 22*a* is used when the original G is read without using the document feeding portion 10. The second reading surface 22*a* is formed along a top face of a second contact glass 22 on which the original G is placed, and serves as a surface on which the original G is read.

In addition, the document reading portion 20 includes a lighting portion 23, first mirror 24, second mirror 25, third mirror 26, imaging lens 27, and image capturing portion 28 inside the copy machine main body 2. The lighting portion 23 and the first mirror 24 each move in a sub-scanning direction X. The second mirror 25 and the third mirror 26 are arranged to the left side of the lighting portion 23 and the first mirror 24 in FIG. 1. Furthermore, the second mirror 25 and the third mirror 26 are each movable in the sub-scanning direction X while maintaining a fixed distance (light path length) from the first reading surface 21*a* or the second reading surface 22*a* to the image capturing portion 28, through the first mirror 24, second mirror 25, third mirror 26 and imaging lens 27.

The lighting portion 23 is a light source that emits light onto the original G. The first mirror 24, second mirror 25 and third mirror 26 are mirrors for guiding light reflected off the original G onto the imaging lens 27, while maintaining the light path length constant. The imaging lens 27 causes light incident from the third mirror 26 to form an image on the image capturing portion 28. The image capturing portion 28 includes a plurality of imaging elements aligned along a main-scanning direction (direction orthogonal to the sub-scanning direction X). An imaging element acquires image data based on a formed optical image by converting the incident light into electrical signals. The imaging element is a charge-coupled device (CCD), for example.

The first sheet feeding portion 30 includes a second feed roller 31, third feed roller 32, pair of registration rollers 33, switching portion 39, first sheet discharging portion 34, and second sheet discharging portion 38. The second feed roller 31 supplies a sheet of medium T stored in a sheet feed cassette 36 to the transfer portion 50. The third feed roller 32 supplies a sheet of medium T placed on a manual sheet feed tray 37 to the transfer portion 50. The pair of registration rollers 33 performs feeding of a sheet of medium T or interrupts feeding of the sheet of medium T in order to match the timing at which a toner image is formed on the transfer portion 50 and the timing of supplying the sheet of medium T to the transfer portion 50. In addition, the pair of registration rollers 33 performs skew (skew sheet supply) compensation of the sheet of medium T.

The switching portion 39 switches a feeding direction of the sheet of medium T so as to feed the sheet of medium T conveyed from the fixing portion 60 to either one of the first sheet discharging portion 34 and the second sheet discharging portion 38. The first sheet discharging portion 34 and the second sheet discharging portion 38 each discharge the sheet of medium T on which a toner image has been fixed to outside the copy machine main body 2. A discharged sheet collecting portion 35 is formed at the first sheet discharging portion 34 outside the copy machine main body 2. Sheets of media T discharged from the first sheet discharging portion 34 are stacked and collected in a stacking direction (direction of the arrow Z) on the discharged sheet collecting portion 35.

The image forming portion 40 includes photoreceptor drums 41, charging portions 42, laser scanner units 43, developing units 44, cleaning portions 45, toner cartridges 46, primary transfer rollers 47, an intermediate transfer belt 48, and an opposing roller 49.

The photoreceptor drums 41 (41*a*, 41*b*, 41*c*, 41*d*) function as photoreceptors or image carriers for forming toner images in black, cyan, magenta and yellow, respectively. At a circumference of each of the photoreceptor drums 41*a*, 41*b*, 41*c* and 41*d*, a charging portion 42, laser scanner unit 43, developing unit 44 and cleaning portion 45 are arranged in order of upstream to downstream in a rotational direction of each of the photoreceptor drums 41.

The charging portion 42 charges a surface of the photoreceptor drum 41. The laser scanner unit 43, which is arranged away from the surface of the photoreceptor drum 41, performs scanning exposure of the surface of the photoreceptor drum 41 based on image data relating to the original G read by the document reading portion 20. Accordingly, charges are removed from an exposed portion of the surface of the photoreceptor drum 41 and an electrostatic latent image is formed on it. The developing unit 44 causes toner to adhere to the electrostatic latent image formed on the surface of the photoreceptor drum 41 to form a toner image. After whole electricity on the surface of the photoreceptor drum 41 has been removed by a static eliminator (not illustrated), the cleaning portion 45 removes toner and the like remaining on this surface.

The toner cartridges 46 hold toner of each color to be supplied to the developing units 44. The toner cartridges 46 and developing units 44 are connected by toner supply channels (not illustrated), respectively.

The primary transfer rollers 47 (47*a*, 47*b*, 47*c*, 47*d*) are arranged on opposite sides of the intermediate transfer belt 48 than the photoreceptor drums 41*a*, 41*b*, 41*c* and 41*d*. The intermediate transfer belt 48 is a belt that passes through the image forming portion 40 and transfer portion 50. A portion of the intermediate transfer belt 48 is inserted between the photoreceptor drums 41*a*, 41*b*, 41*c* and 41*d*, and the primary transfer rollers 47*a*, 47*b*, 47*c* and 47*d*, respectively. The toner images formed on the surfaces of photoreceptor drums 41*a*, 41*b*, 41*c* and 41*d* are each primarily transferred to the intermediate transfer belt 48. The opposing roller 49 is a drive roller that is arranged on a rear side of the annular intermediate transfer belt 48 and causes the intermediate transfer belt 48 to travel in a direction of an arrow V shown in FIG. 1.

The transfer portion 50 includes a secondary transfer roller 51. The secondary transfer roller 51, which is arranged on an opposite side of the intermediate transfer belt 48 than the opposing roller 49, sandwiches a portion of the intermediate transfer belt 48 therebetween. Furthermore, the secondary transfer roller 51 causes the toner images primarily transferred to the intermediate transfer belt 48 to be secondarily transferred to the sheet of medium T.

The fixing portion 60 includes a heating roller 61 and pressure roller 62. The heating roller 61 and the pressure roller 62 sandwich the sheet of medium T to which a toner image has been secondarily transferred, such that the toner is melted and applied pressure to be fixed on the sheet of medium T.

Post-Processing Device 100

The post-processing device 100 includes a second sheet feeding portion 110 as a feeding portion, punching portion 120, stapling portion 130, folding portion 140, sheet aligning mechanism 200, and post-processing device main body M serving as a housing. The second sheet feeding portion 110, punching portion 120, stapling portion 130, folding portion 140, and sheet aligning mechanism 200 are installed in the post-processing device main body M.

The second sheet feeding portion 110 includes an in-feed portion 111, branching guide 112, and first discharging portion 113. The in-feed portion 111 takes in the sheet of medium T discharged from the second sheet discharging portion 38 of the copy machine main body 2, and then feeds this sheet of medium T to the punching portion 120. The branching guide 112 switches the feeding direction of the sheet of medium T discharged from the punching portion 120 to either one of the first discharging portion 113 and the stapling portion 130.

The first discharging portion 113 includes a feed rotation shaft 113*a*, feed rotation shaft drive portion 113*d* that causes the feed rotation shaft 113*a* to rotate (refer to FIG. 9), and a pair of feed rollers 113*b*, 113*c* that is rotated by the fed rotation shaft 113*a*. It is preferable to employ a drive device capable of open control such as a stepping motor for the feed rotation shaft drive portion 113*d*.

The first discharging portion 113 discharges a sheet of medium T discharged from the punching portion 120 and a sheet of medium T discharged from the stapling portion 130 outside the post-processing device 100. A main tray 114 is arranged to extend in a feed direction F (refer to FIG. 3) with respect to the first discharging portion 113. Sheets of media T discharged from the first discharging portion 113 are stacked and collected on the main tray 114.

The punching portion 120 performs sequential processing related to punching to form holes used for binding the sheets of media T at predetermined positions.

The stapling portion 130 binds (staples) the sheets of media T together by staples, and includes a sheet receiving table 131, catch portion 132, stapling portion 133, and feeding roller 134. The sheet receiving table 131 temporarily collects the sheets of media T fed in from the punching portion 120 in accordance with switching of the branching guide 112. The catch portion 132 catches to retain a lower edge of a sheet of medium T fed in to the sheet receiving table 131. The stapling portion 133 moves to the vicinity of an edge or the center of the sheets of media T temporarily collected on the sheet receiving table 131, and performs stapling at the vicinity of the edge or the center. The feeding roller 134 feeds a bundle of the sheets of media T, in the vicinity of the center of which stapling has been performed (center stapled), from the sheet receiving table 131 to the folding portion 140.

The folding portion 140 is configured to cause the bundle of the sheets of media T with center stapling to be folded in two at the vicinity of the center (folding process). The folding portion 140 includes a fold receiving table 141, depressing portion 142, pair of fold rollers 143, and second discharging portion 144. The fold receiving table 141 accepts the placement of the bundle of the sheets of media T with center stapling performed by the stapling portion 130. The depressing portion 142 is configured to be movable in a direction orthogonal to the bundle of the sheets of media T placed on the fold receiving table 141. The depressing portion 142 moves towards the bundle of the sheets of media T. Subsequently, the depressing portion 142 depresses the vicinity of the center of the bundle of the sheets of media T (portion with stapling) towards the pair of fold rollers 143, which is arranged opposite to the depressing portion 142 with respect to the bundle of the sheets of media T.

The pair of fold rollers 143 causes the bundle of the sheets of media T depressed by the depressing portion 142 to be folded in a bound book form, and feeds the bundle of the sheets of media T thus folded to the second discharging portion 144. The second discharging portion 144 discharges the folded sheets of media T from the post-processing device 100. A discharge tray 145 is arranged at the second discharging portion 144 outside the post-processing device 100. The bundle of the sheets of media T discharged from the second discharging portion 144 is collected on the discharge tray 145.

Sheet Aligning Mechanism 200

Next, the sheet aligning mechanism 200 will be explained. The sheet aligning mechanism 200 is configured to cause a sheet of medium T fed from the pair of feed rollers 113*b*, 113*c* of the first discharging portion 113 to move in a shift direction Y (direction orthogonal to the feed direction F and stacking direction of sheets), so that the sheet of medium T is aligned at a predetermined position on the main tray 114. The sheet aligning mechanism 200 will be explained in detail hereinafter.

Figure 2:
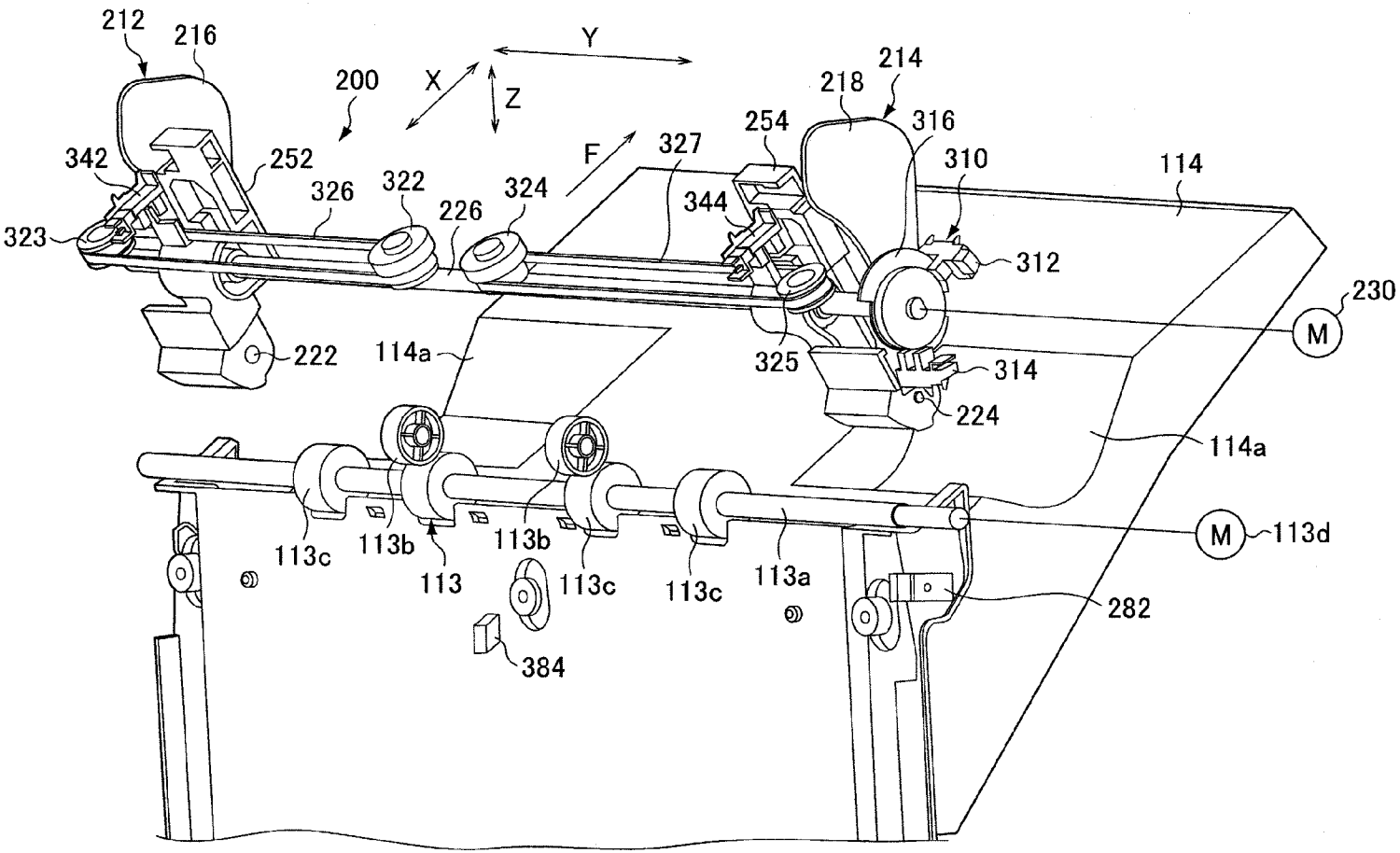
FIG. 2 is a perspective view of a portion of a post-processing device 100 shown in FIG. 1.
Figure 9:
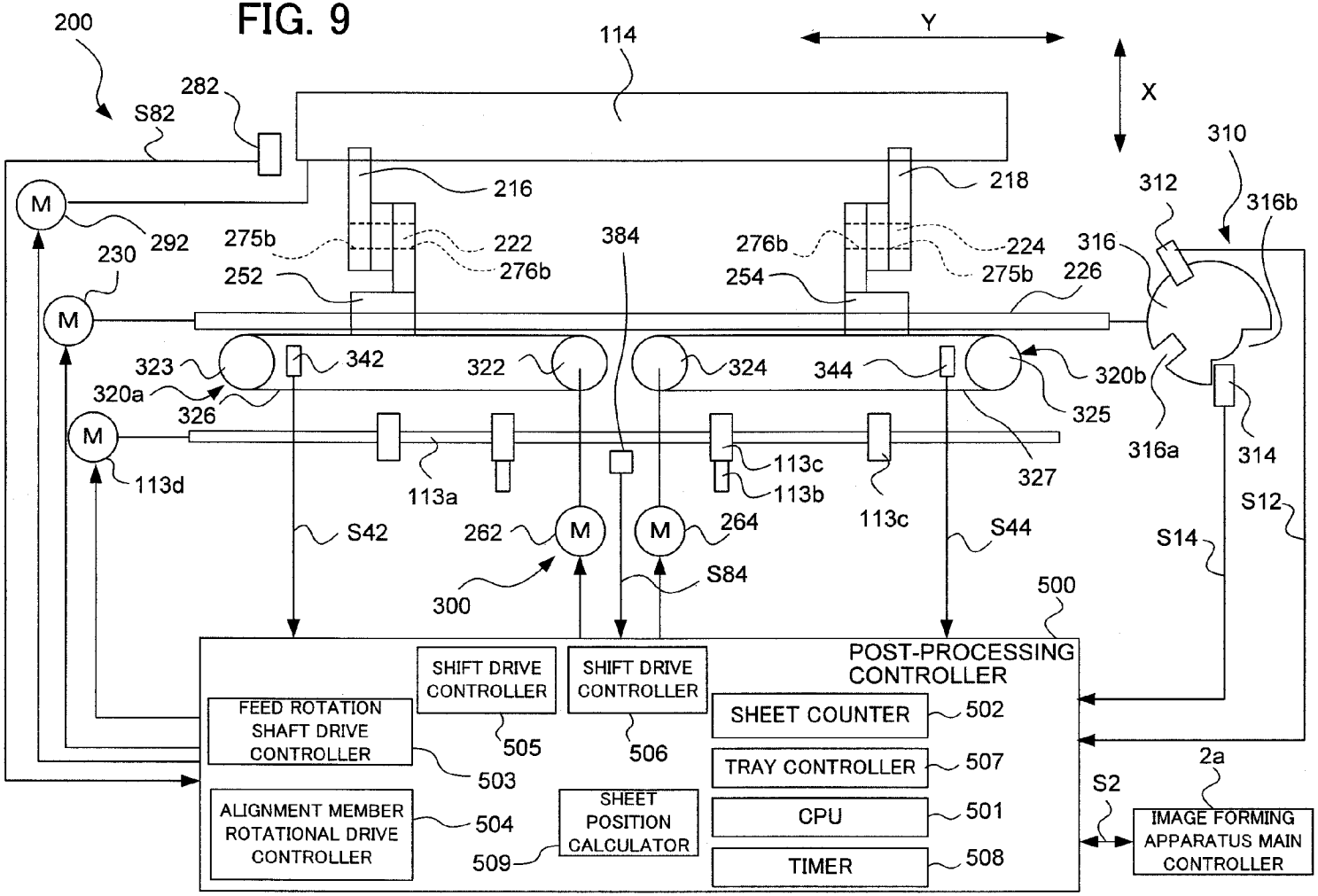
FIG. 9 is a block diagram of the post-processing device 100 shown in FIG. 2.

As shown in FIG. 2, the sheet aligning mechanism 200 includes a pair of alignment members 212, 214; pair of alignment member rotation shafts 222, 224; alignment member rotational drive portion 230 (refer to FIG. 9); guide rail 226 extending in the shift direction (the direction of the arrow Y); pair of guide bases 252, 254; pair of base conveying mechanisms 320*a*, 320*b* (refer to FIG. 9); rotation detection mechanism 310 as a rotational waiting position detector; rectilinear waiting position detectors 342, 344; and post-processing controller 500 (refer to FIG. 9). The alignment member rotational drive portion 230 and the pair of base conveying mechanisms 320*a*, 320*b* configure a rotational movement drive mechanism 300. The pair of alignment member rotation shafts 222, 224 and the guide rail 226 configure an alignment member support portion.

Pair of Alignment Members 212, 214

Figure 5:
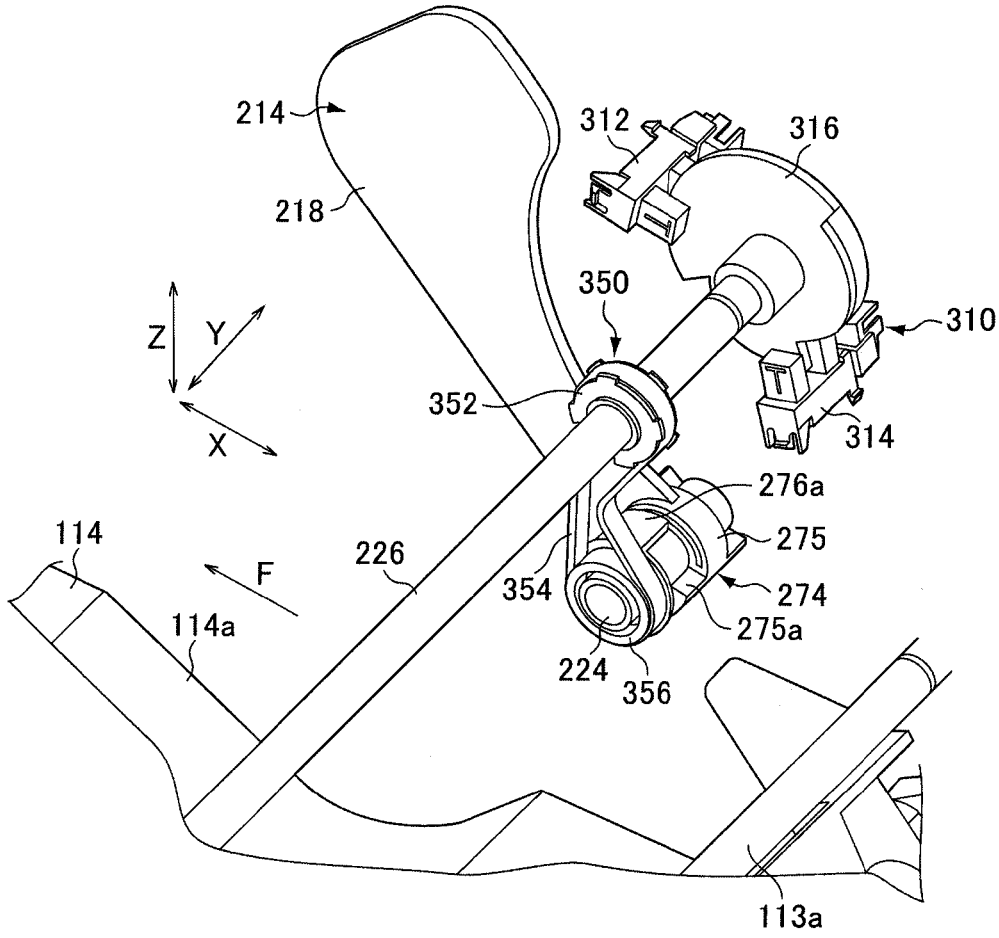
FIG. 5 is a partial perspective view of a sheet aligning mechanism 200 of the post-processing device 100 shown in FIG. 2.

As shown in FIGS. 2, 3, 5 and 6, an alignment member 212 (214) includes an alignment surface 216 (218), coupling 272 (274) (refer to FIGS. 5 and 6) and rotation transmission mechanism 350 (350) (refer to FIG. 5). The pair of alignment members 212, 214 is configured to cause a sheet of medium T placed on an upper side of the main tray 114 in the stacking direction (direction of the arrow Z) to move in the shift direction (direction of the arrow Y), such that the sheet of medium T is aligned.

The alignment member 212 (214) has the alignment surface 216 (218) that extends to extend into a region 114*b* above the main tray 114 in the stacking direction (direction of the arrow Z), respectively.

Alignment Surfaces 216, 218

Figure 3:
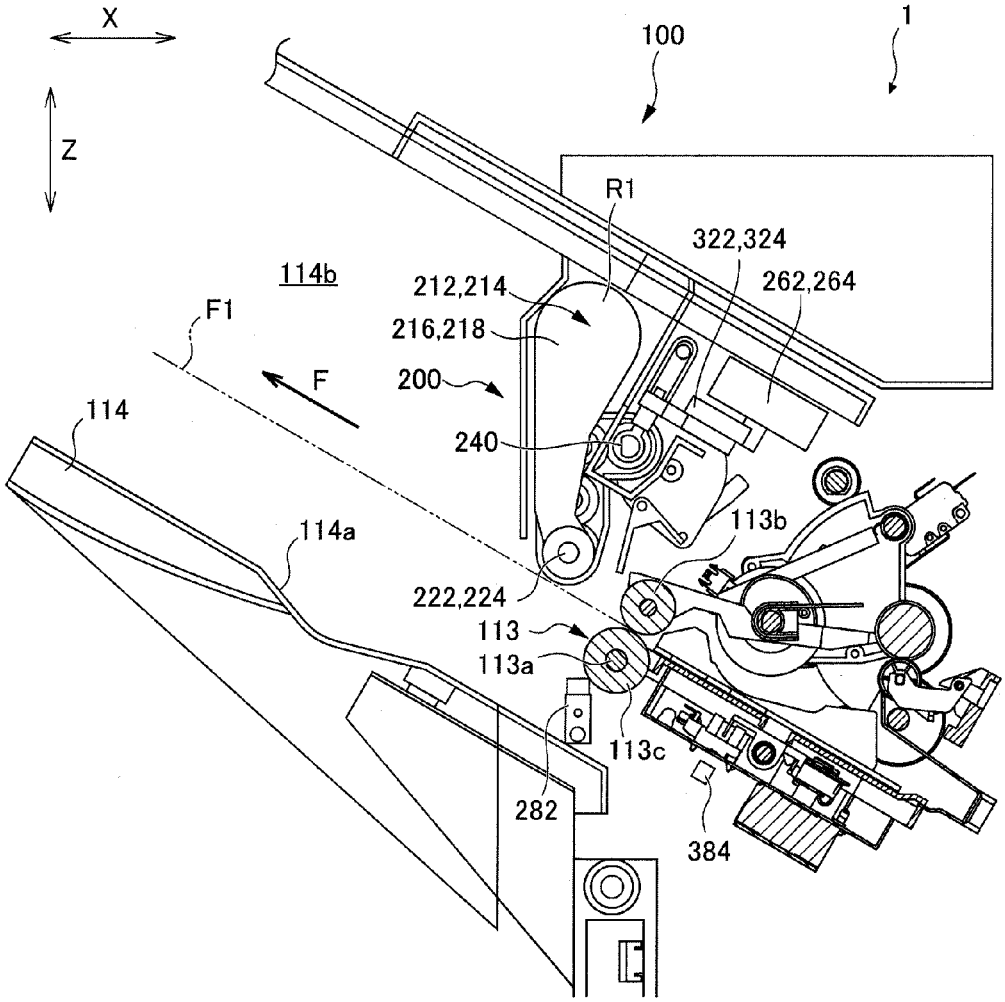
FIG. 3 is a vertical cross-sectional view of a portion of the post-processing device 100 shown in FIG. 2.
Figure 12:
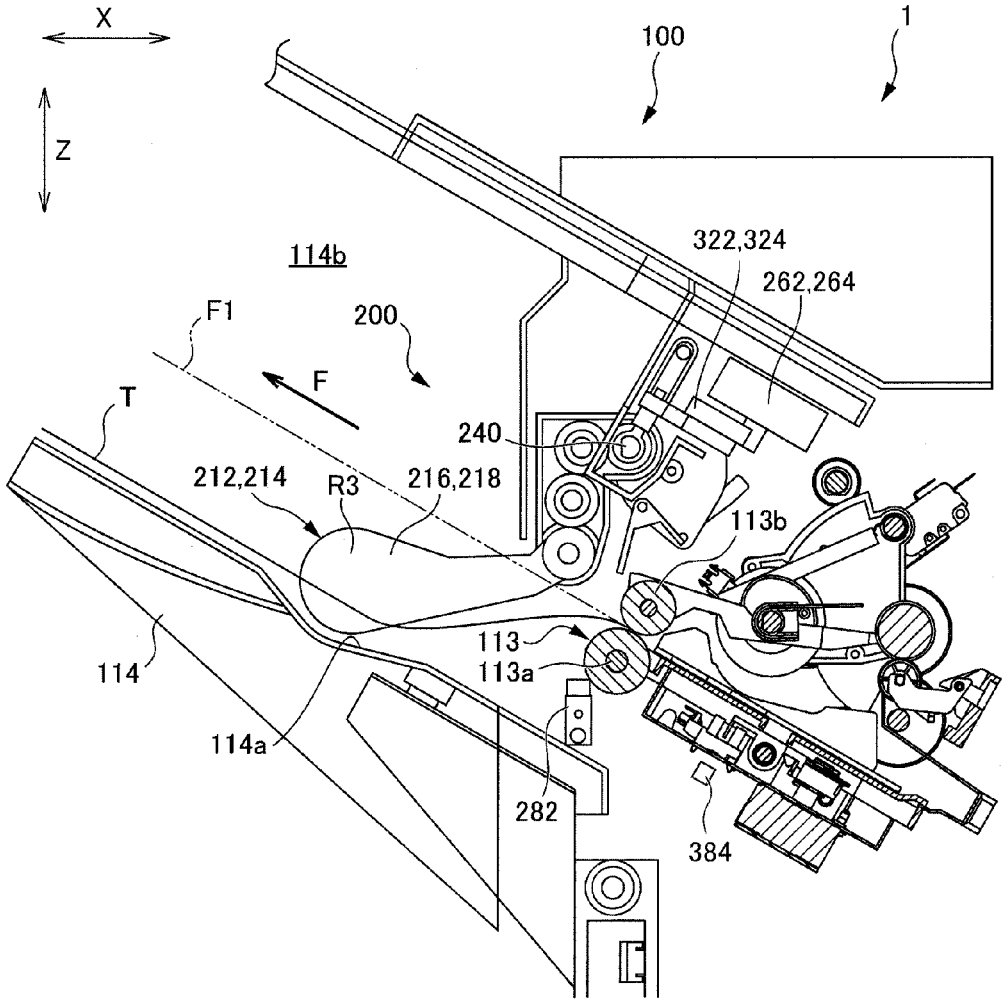
FIG. 12 is a vertical cross-sectional view illustrating operation of the post-processing device shown in FIG. 2.

As shown in FIGS. 2 and 3, each of the pair of alignment surfaces 216, 218 is configured to push an edge of a sheet of medium T (refer to FIG. 13) in the shift direction (direction of the arrow Y). Each of the pair of alignment surfaces 216, 218 is formed substantially in a shape of a plate having a plane extending in the stacking direction (direction of the arrow Z) and the feed direction F. As shown in FIG. 12, a leading end of each of the pair of alignment surfaces 216, 218 is formed in a convex shape so as to enter a concavity 114*a* recessed into the main tray 114 substantially downward. Therefore, the leading end of each of the pair of alignment surfaces 216, 218 is configured to be positionable lower than a top surface of the main tray 114.

A base of the alignment member 212 (214) is rotatably attached to the alignment member rotation shaft 222 (224) via the coupling 272 (274). The coupling 272 (274) is rotatably attached around the alignment member rotation shaft 222 (224), which extends in the shift direction (direction of the arrow Y).

Couplings 272, 274

Figure 6:
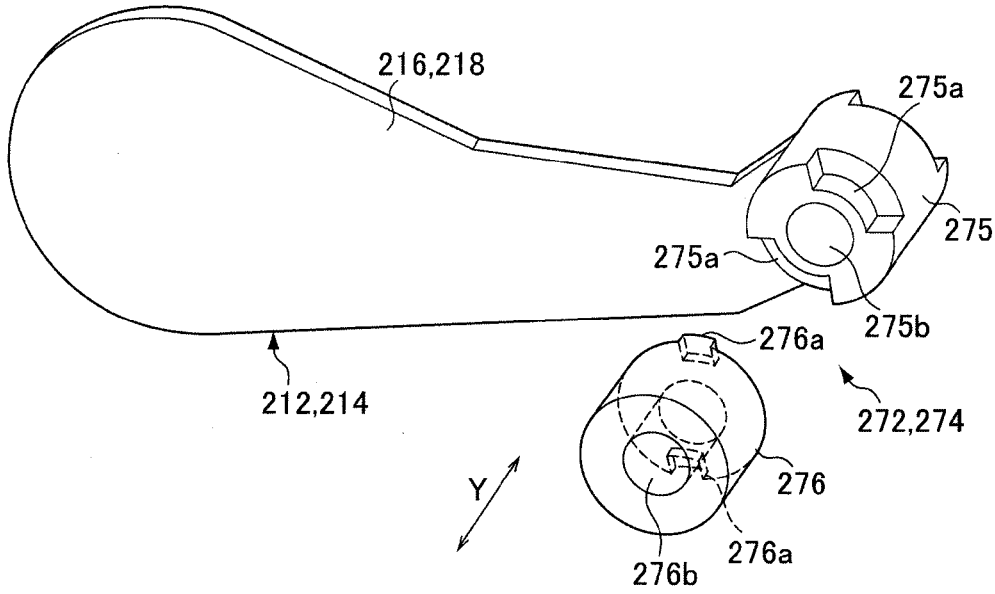
FIG. 6 is a partial exploded perspective view of the sheet aligning mechanism 200 of the post-processing device 100 shown in FIG. 2.

As shown in FIG. 6, the coupling 274 has a pair of hubs 275, 276. Similarly to the coupling 274, the coupling 272 also has a pair of hubs 275, 276. A description will be given of the coupling 274 hereinafter, and an explanation for the coupling 272 will be omitted.

One hub 275 and the alignment surface 218 are integrally configured to be unrotatable relative to each other.

The one hub 275 is formed in a cylindrical shape having a through hole 275*b* through which the alignment member rotation shaft 224 is inserted. A step portion 275*a* is formed at an end of the one hub 275. The step portion 275*a* has cutouts at its end portions when viewed in a cross-sectional shape of the one hub 275 with respect to a direction of the center line. The step 275*a* is formed to have a length approximately ¼ the circumference of the end of the one hub 275 in a circumferential direction of the end of the one hub 275.

Figure 7:
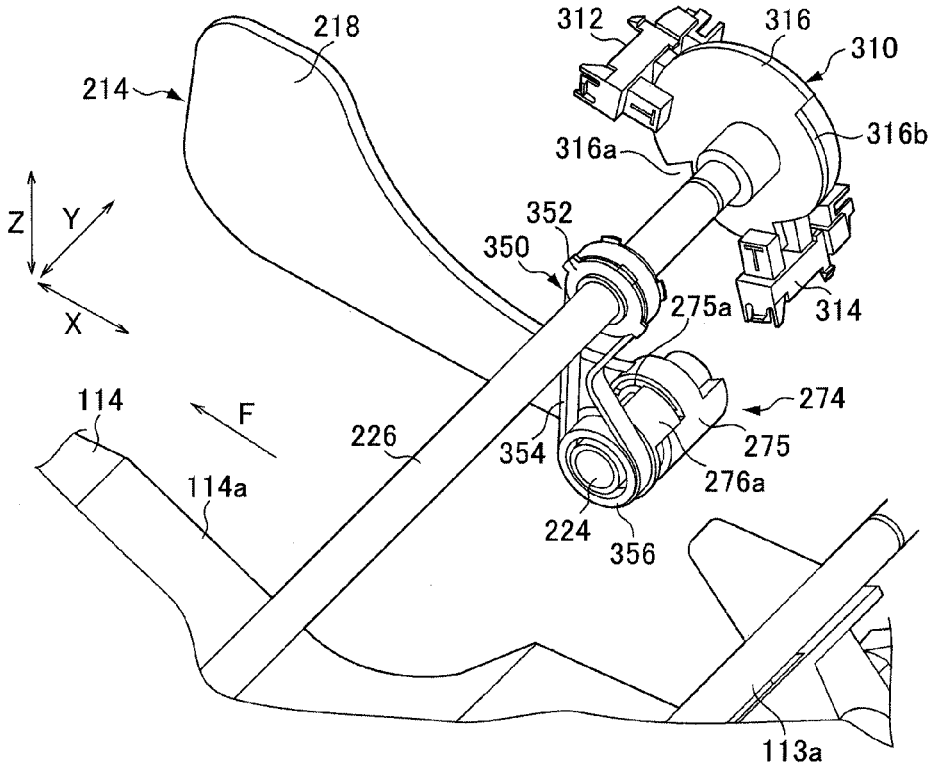
FIG. 7 is a partial perspective view illustrating the movement of an alignment surface 218 of the sheet aligning mechanism 200 in the post-processing device 100 shown in FIG. 2.
Figure 8:
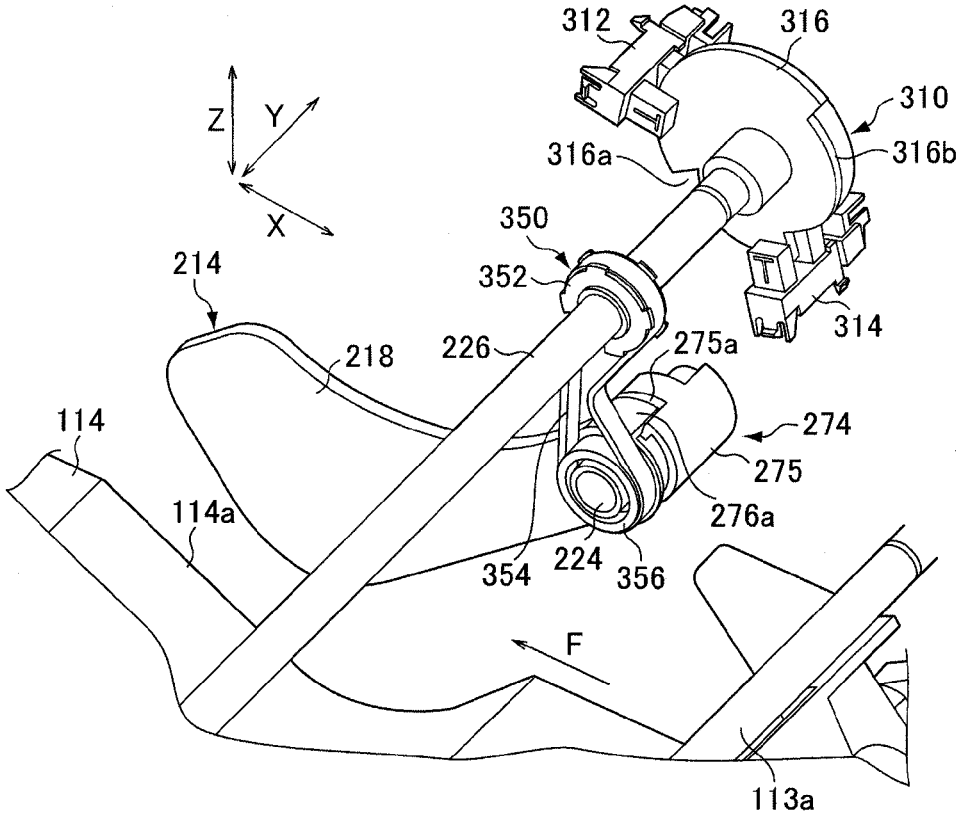
FIG. 8 is a partial perspective view illustrating the movement of the alignment surface 218 continued from FIG. 7.

An other hub 276 is formed in a substantially cylindrical shape having a through hole 276*b* through which the alignment member rotation shaft 224 is inserted. At the end of the other hub 276, a protrusion 276*a* is formed extending from an end of the other hub 276 in an outward direction with respect to a central axis of the other hub 276. The protrusion 276*a* movably fits into the step 275*a* in the circumferential direction, when the end of the other hub 276 comes into contact with the end of the one hub 275. Therefore, as shown in FIGS. 7 and 8, the one hub 275 couples to the other hub 276 while the one hub 275 is movable by a predetermined angle (in the present embodiment, approximately 90°, which is ¼ of 360°) relative to the other hub 276.

Rotation Transmission Mechanism 350

As shown in FIG. 5, the rotation transmission mechanism 350 has a first pulley 352, second pulley 356, and endless timing belt 354. The first pulley 352 is attached to the guide rail 226, while it is unrotatable and rectilinearly movable in an axial direction (direction of the arrow Y) relative to the guide rail 226. The second pulley 356 is unrotatably attached to the other hub 276. The endless timing belt 354 is suspended between the first pulley 352 and the second pulley 356 so as to transfer the torque of the first pulley 352 to the second pulley 356.

Alignment Member Rotational Drive Portion 230

As shown in FIGS. 2 and 5, the alignment member rotational drive portion 230 is immovably attached to the post-processing device main body M. The rotational output of the alignment member rotational drive portion 230 (refer to FIG. 2) is transferred to the other hub 276 to which the second pulley 356 is attached, via the guide rail 226 and the rotation transmission mechanism 350 (refer to FIG. 5). Therefore, the coupling 272 is configured so that the action of the alignment member rotational drive portion 230 causes the other hub 276 to rotate.

The alignment member rotational drive portion 230 causes the pair of alignment surfaces 216, 218 to rotate simultaneously so as to travel around the alignment member rotation shafts 222, 224.

Figure 19:
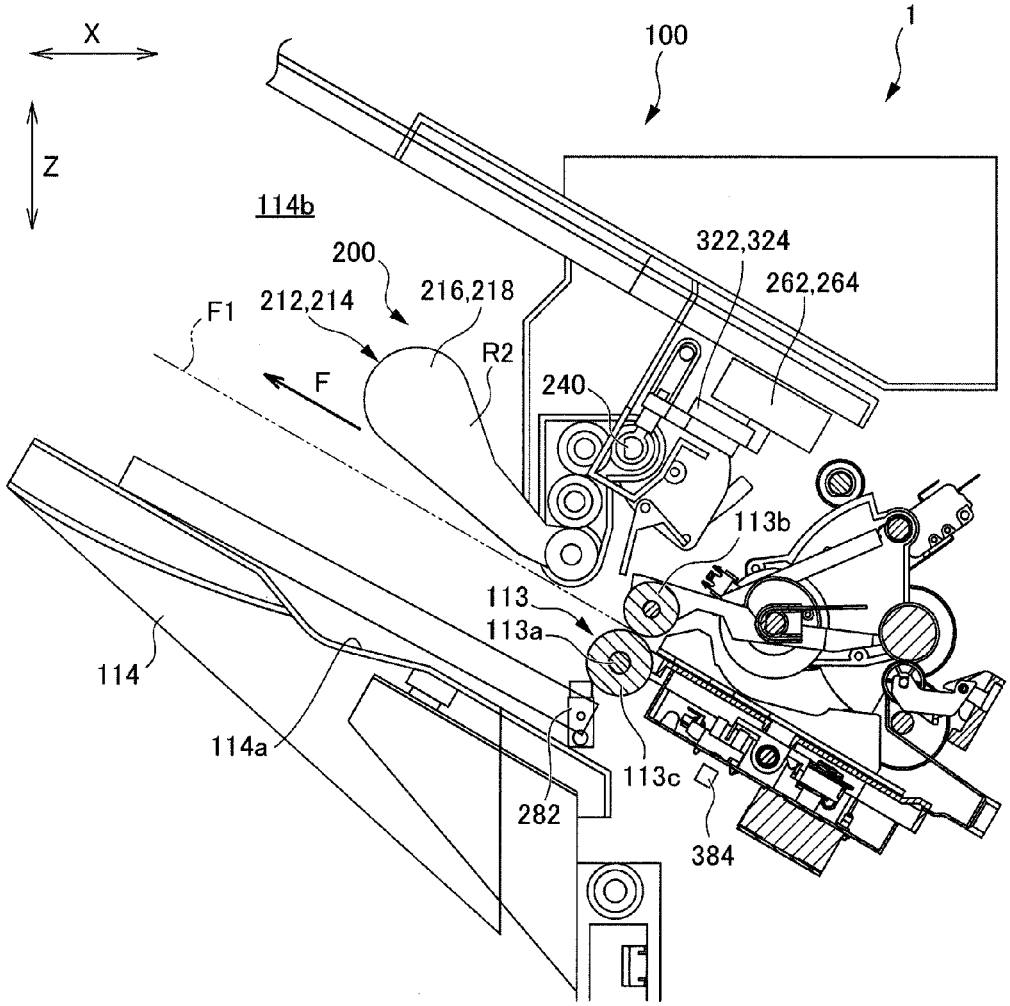
FIG. 19 is a vertical cross-sectional view showing correction of the sheet aligning mechanism 200 of the post-processing device 100 shown in FIG. 2.

The output shaft of the alignment member rotational drive portion 230 (refer to FIG. 2) rotates in a range in which the pair of alignment surfaces 216, 218 swings between a stored position R1 (refer to FIG. 3) and a standby position R3 (refer to FIG. 12) through a waiting position R2 (refer to FIG. 19). It may be preferable but not necessary that the waiting position R2 is arranged above a feed plane F1. In addition, it may be preferable but not necessary that a drive device capable of open control such as a stepping motor is adopted for the alignment member rotational drive portion 230.

Alignment Member Rotation Shafts 222, 224

As shown in FIG. 2, the pair of alignment member rotation shafts 222, 224 is supported by the pair of guide bases 252, 254, respectively, such that the pair of alignment member rotation shafts 222, 224 is rectilinearly immovable. One guide base 252 is attached to the guide rail 226 so as to be movable in the shift direction (direction of the arrow Y) and unrotatable around the guide rail 226. The other guide base 254 is also attached to the guide rail 226 so as to be movable in the shift direction (direction of the arrow Y) and unrotatable around the guide rail 226.

As shown in FIG. 3, the pair of guide bases 252, 254 supports the pair of alignment member rotation shafts 222, 224, respectively, so that the pair of alignment member rotation shafts 222, 224 is located proximity to the feed plane F1 in the stacking direction (direction of the arrow Z). More specifically, the pair of alignment member rotation shafts 222, 224 is disposed above the feed plane F1. The feed plane F1 is a virtual plane on which a lower portion of each of the pair of alignment member rotation shafts 222, 224 extends from the pair of feed rollers 113*b*, 113*c* in the feed direction F.

Herein, it may be preferable but not necessary that a range in the feed direction F in which the alignment surfaces 216, 218 come into contact with a sheet of medium T stacked on the main tray 114 is determined as described below. It should be noted that the range of contact with the sheet of medium T corresponds to a displacement d in FIG. 18. For example, the range is selected such that obstruction does not occur when the alignment surfaces 216, 218 perform alignment operation to cause the stacked sheet of medium T to move in the shift direction Y.

Therefore, the distance between the lower portion of each of the pair of alignment member rotation shafts 222, 224 and the feed plane F1 is, preferably but not necessarily, a distance establishing a range in which such obstruction does not occur in the alignment operation.

For example, it may be preferable but not necessary that the distance between the lower portion of each of the pair of alignment member rotation shafts 222, 224 and the feed plane F1 is shorter than twice the distance of the outside diameter of the pair of couplings 272, and more preferably shorter than the outside diameter of the pair of couplings 272. In addition, it may be preferable but not necessary that the distance between the lower portion of each of the pair of alignment member rotation shafts 222, 224 and the feed plane F1 is shorter than a distance twice the diameter of each of the pair of alignment member rotation shafts 222, 224, and more preferably shorter than the diameter of each of the pair of alignment member rotation shafts 222, 224.

As shown in FIG. 9, one guide base 252 connects the first pulley 352 to be movable in the shift direction (direction of the Y arrow) relative to the guide rail 226. In addition, the first pulley 352 is immovably connected to the one guide base 252 in the shift direction (direction of the arrow Y). The other guide base 254 also connects another first pulley 352 to be movable in the shift direction (direction of the Y arrow) relative to the guide rail 226. In addition, the other first pulley 352 is immovably connected to the other guide base 254 in the shift direction (direction of the arrow Y).

Figure 4:
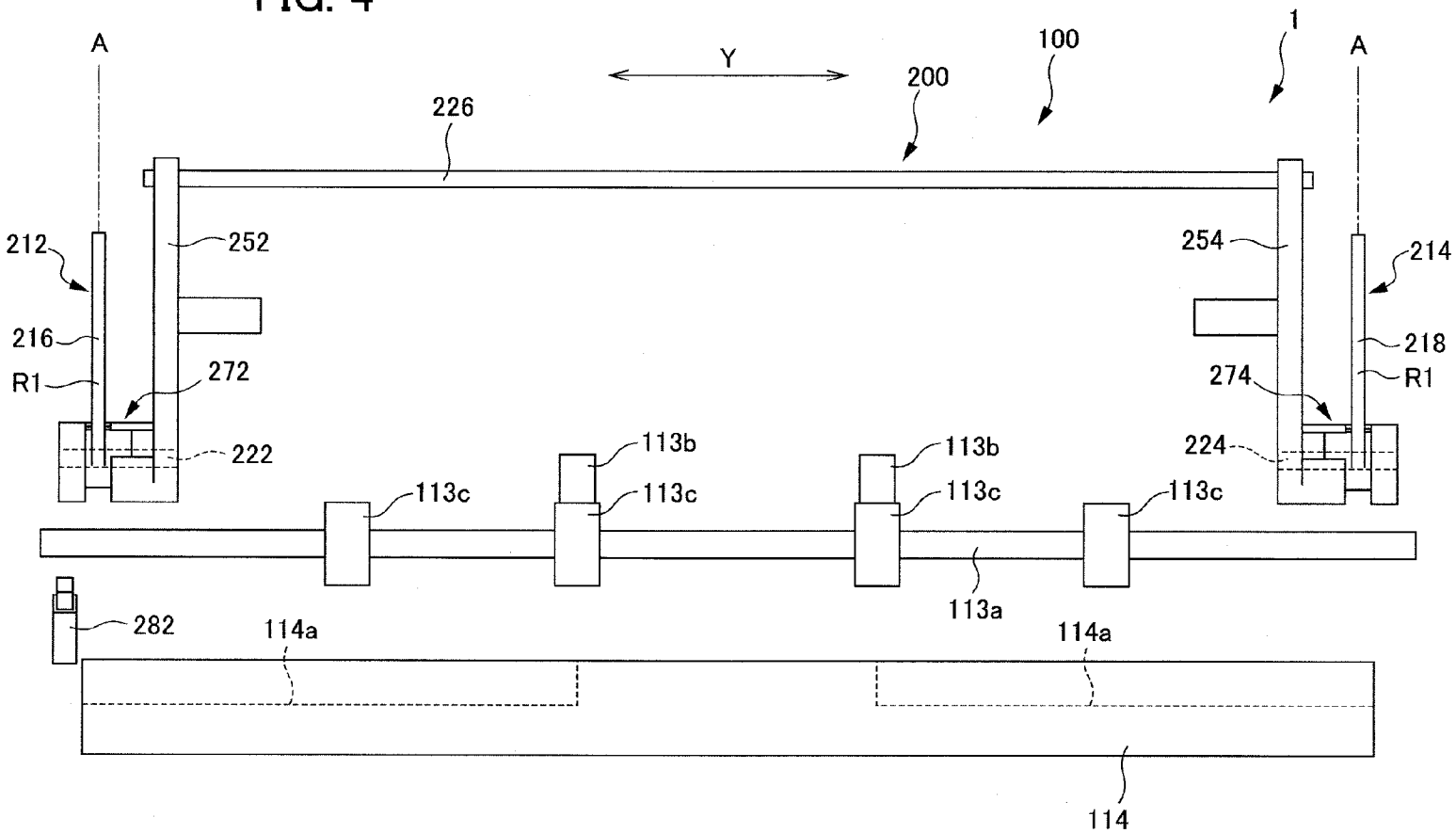
FIG. 4 is a schematic plan view of the portion of the post-processing device 100 shown in FIG. 2 when viewed from a direction of an arrow Z.

As shown in FIG. 4, the alignment member rotation shafts 222, 224 are disposed spaced in the shift direction (direction of the arrow Y) so that the shaft lines of each match in the shift direction. The distance between the alignment member rotation shafts 222 and 224 is approximately equal to the dimension of a sheet of medium T in the shift direction (direction of the arrow Y) when the alignment members 212, 214 are standing by at a waiting position A.

Guide Rail 226

As shown in FIG. 2, the guide rail 226 is supported by the post-processing device main body M such that an extending direction of the guide rail 226 matches the shift direction (direction of the arrow Y). The guide rail 226 is supported by the post-processing device main body M to be relatively rotatable and immovable in the shift direction (direction of the arrow Y). The guide rail 226 is composed of a parallel spline shaft and a linear rail, for example.

The rotation detection mechanism 310 is attached to one end of the guide rail 226. The rotation detection mechanism 310 is configured to detect whether the guide rail 226 has rotated a predetermined rotational angle relative to the post-processing device main body M.

Rotation Detection Mechanism 310

As shown in FIGS. 5 and 9, the rotation detection mechanism 310 includes a rotation disk 316, waiting confirmation sensor 312, and alignment set confirmation sensor 314. The rotation disk 316 is unrotatably attached to the guide rail 226, such that the rotation disk 316 is parallel with a plane orthogonal to the shift direction (direction of the arrow Y). As shown in FIG. 9, the rotation disk 316 has a waiting confirmation cutout 316*a* and an alignment set confirmation cutout 316*b* along a circumferential direction. When the pair of alignment surfaces 216, 218 is disposed at the waiting position R2 (refer to FIG. 19) on a plane extending in the feed direction F and the stacking direction, the waiting confirmation cutout 316 moves rotationally to the position of the waiting confirmation sensor 312. At this time, the waiting confirmation sensor 312 is configured to output an ON waiting signal S12 to a CPU 501 of the post-processing controller 500. In addition, when the pair of alignment surfaces 216, 218 has not moved to the waiting position, the waiting confirmation sensor 312 is configured to output an OFF waiting signal S12 to the CPU 501 of the post-processing controller 500.

When each of the pair of alignment surfaces 216, 218 is disposed above the main tray 114 in the direction of the arrow Z in a plane extending in the feed direction F and the stacking direction, each of the pair of alignment surfaces 216, 218 enters the region 114*b* above the main tray 114. Then, the alignment set confirmation cutout 316*b* moves rotationally to the position of the alignment set confirmation sensor 314. At this time, the alignment set confirmation sensor 314 is configured to output an ON confirmation signal S14 to the CPU 501 of the post-processing controller 500. In addition, when the pair of alignment surfaces 216, 218 is not disposed above the main tray 114 in the direction of the arrow Z, the alignment set confirmation sensor 314 is configured to output an OFF confirmation signal S14 to the CPU 501 of the post-processing controller 500.

In this manner, the rotation detection mechanism 310 functions as a rotational waiting position detector.

Guide Bases 252, 254

Each of the guide bases 252, 254 is attached to the guide rail 226 such that it is rectilinearly movable and rotatable relative to the guide rail 226. Each of the guide bases 252, 254 is supported by a guide portion (not illustrated) attached to the post-processing device main body M to be movable in parallel to the shift direction (direction of the arrow Y). Therefore, each of the guide bases 252, 254 is movably attached to the guide rail 226 in the shift direction (direction of the arrow Y), while permitting rotation of the guide rail 226.

Base Conveying Mechanisms 320*a*, 320*b*

A base conveying mechanism 320*a* (320*b*) includes a guide base portion 252 (254), shift endless timing belt 326 (327), slave pulley 323 (325), drive pulley 322 (324), and shift drive portion 262 (264). It may be preferable but not necessary that a drive device capable of open control such as a stepping motor is adopted for the shift drive portions 262, 264, for example.

Slave pulleys 323, 325 and drive pulleys 322, 324 are rotatably attached to the post-processing device main body M. The shift endless timing belt 326 (327) is suspended between the slave pulley 323 (325) and the drive pulley 322 (324). A portion of the shift endless timing belt 326 (327) is immovably attached to the guide base 252 (254). The drive pulley 322 (324) is attached to the post-processing device main body M so that the rotational output of an output shaft of the shift drive portion 262 (264) is transferred via an intermediate gear or the like not illustrated.

Therefore, the base conveying mechanism 320*a* (320*b*) is configured so that the action of the shift drive portion 262 (264) causes the guide base 252 (254) to move in parallel in the shift direction (direction of the arrow Y). More specifically, the guide base 252 (254) is attached to the guide rail 226 to allow movement of the alignment surface 216 (218) to a waiting position A (refer to FIG. 4), alignment position B (refer to FIGS. 13 and 16), standby position C refer to FIGS. 13 and 17), and retaining position D (refer to FIG. 15) in the shift direction (direction of the arrow Y).

When the alignment surface 218 is located at the alignment position B, a sheet of medium T is placed at a stacking position on a rear side in the shift direction (direction of the arrow Y). When the alignment surface 216 is located at the alignment position B, a sheet of medium T is placed at a stacking position on a front side in the shift direction (direction of the arrow Y).

Rectilinear Waiting Position Detectors 342, 344

The sheet aligning mechanism 200 includes rectilinear waiting position detectors 342, 344 immovably attached to the post-processing device main body M. The rectilinear waiting position detector 342 (344) is configured to detect whether the alignment surface 216 (218) has moved to the waiting position A (refer to FIG. 4) of accommodation, within the range of motion in which the alignment surface 216 (218) is movable in the shift direction (direction of the arrow Y). When the rectilinear waiting position detector 342 (344) detects that the alignment surface 216 (218) has moved to the waiting position A, it outputs an ON standby detection signal S42 (S44) to the CPU 501 of the post-processing controller 500. When the rectilinear waiting position detector 342 (344) does not detect that the alignment surface 216 (218) has moved to the waiting position A, it outputs an OFF standby detection signals S42 (S44) to the CPU 501 of the post-processing controller 500.

Sheet Discharge Detection Sensor 384

As shown in FIG. 2, a sheet discharge detection sensor 384 is disposed upstream of the pair of feed rollers 113*b*, 113*c* in the feed direction F. As shown in FIG. 9, the sheet discharge detection sensor 384 outputs an ON discharge detection signal S84 to a sheet counter 502 of the post-processing controller 500, when a sheet of medium T passing through the pair of feed rollers 113*b*, 113*c* is at a detection position of the sheet discharge detection sensor 384. The sheet discharge detection sensor 384 outputs an OFF discharge detection signal S84 to the sheet counter 502 of the post-processing controller 500, when a sheet of medium T does not exist at the detection position of the sheet discharge detection sensor 384. In this manner, the sheet discharge detection sensor 384 functions as a sheet passage detector.

Tray Vertical Movement Drive Portion 292

As shown in FIG. 9, a tray vertical movement drive portion 292 is configured to cause the main tray 114 to move in the direction of the arrow Z. It is preferable but not necessary that a drive device capable of open control such as a stepping motor is adopted for the tray vertical movement drive portion 292, for example. The tray vertical movement drive portion 292 functions as a tray movement mechanism.

Loading Sensor 282

As shown in FIG. 2, a loading sensor 282 is provided at an end of the main tray 114 in the shift direction (direction of the arrow Y). The loading sensor 282 outputs an ON loading signal S82 to the CPU 501 of the post-processing controller 500 when the topmost position of sheets of media T stacked on the main tray 114 reaches a predetermined position relative to the post-processing device main body M. The loading sensor 282 outputs an OFF loading signal S82 to the CPU 501 of the post-processing controller 500 when the topmost position of the sheets of media T stacked on the main tray 114 does not reach the predetermined position relative to the post-processing device main body M. Therefore, the loading sensor 282 functions as a sheet loading detector.

Post-Processing Controller 500

The post-processing controller 500 transmits input/output information of an image forming apparatus main controller 2*a* in a control signal S2. The post-processing controller 500 includes the sheet counter 502, an alignment member rotational drive controller 504, feed rotation shaft drive controller 503, shift drive controllers 505, 506, tray controller 507, and timer 508.

The sheet counter 502 counts the ON discharge detection signals S84 output from the sheet discharge detection sensor 384 in order to calculate the number of sheets of media T passing through the pair of feed rollers 113*b*, 113*c*. The sheet counter 502 outputs a signal of the number thus calculated to the CPU 501. The alignment member rotational drive controller 504 controls the rotation of the alignment member rotational drive portion 230, based on a drive signal output from the CPU 501. The feed rotation shaft drive controller 503 controls rotation of the feed rotation shaft drive portion 113*d*, based on a drive signal output from the CPU 501. The shift drive controllers 505, 506 are configured to control driving of the shift drive portions 262, 264, respectively. The tray controller 507 is configured to control the tray vertical movement drive portion 292 to cause the main tray 114 to move in the direction of the arrow Z.

The timer 508 starts to count time based on a time count start signal output from the CPU 501, and outputs a signal indicating time elapsed when a predetermined time has elapsed (e.g., 1 millisecond (ms) or 2 seconds (s)). It is preferable but not necessary that the predetermined time is the same as the time period during which the post-processing device 100 feeds a sheet of medium T from the pair of feed rollers 113*b*, 113*c* (image formation cycle), or is shorter than the time period of the image formation cycle.

The CPU 501 controls the alignment member rotational drive controller 504, feed rotation shaft drive controller 503, shift drive controllers 505, 506, and tray controller 507, based on the control signal S2, waiting signal S12, confirmation signal S14, loading signal S82, discharge detection signal S84, signal output by the sheet counter 502, and a program stored in advance. The program stored in advance will be described later.

Operation of Post-Processing Device 100

Next, sorting operations of the post-processing device 100 will be explained.

Copy Machine 1 Standby State

When the copy machine 1 is standing by, the alignment surface 216 (218) is stored at the stored position R1 around the alignment member rotation shaft 222 (224), as shown in FIG. 3. In addition, as shown in FIG. 4, the pair of alignment surfaces 216, 218 is located at the waiting position A in the shift direction (direction of the arrow Y).

Typical Alignment Operation

First, when a user starts the copy machine 1, the power source of the post-processing device 100 is turned on, followed by a start-up of the post-processing controller 500.

Initial Operation Determination Processing (Step ST1)

Figure 10:
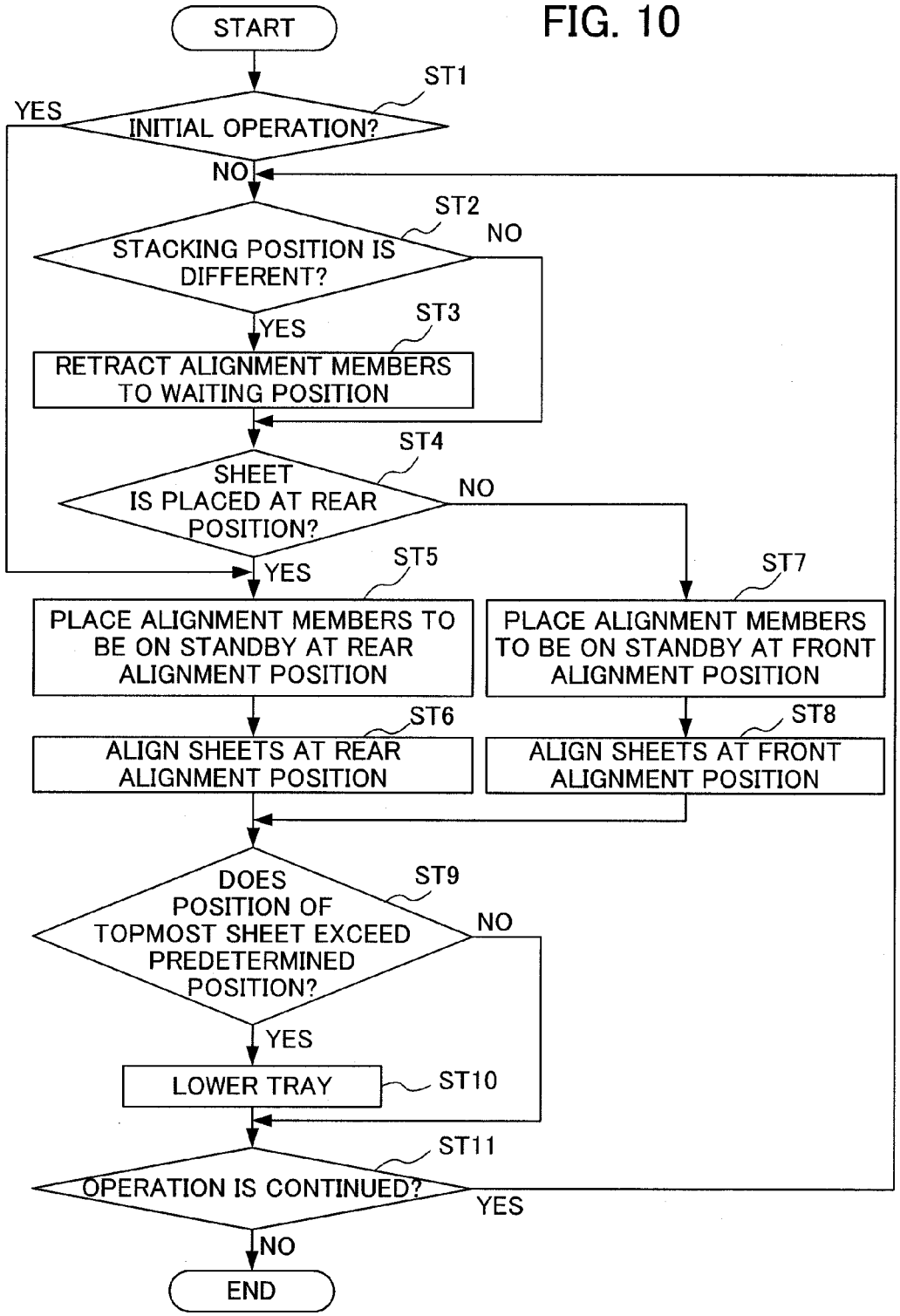
FIG. 10 is a flowchart illustrating operations of the post-processing device 100 shown in FIG. 2.

Next, the CPU 501 performs determination processing of initial operation in Step ST1, as shown in FIG. 10. In other words, the CPU 501 determines whether the copy machine 1 is in an initial operation immediately subsequent to the operation of the post-processing device 100.

If the copy machine 1 is in the initial operation immediately subsequent to the operation of the post-processing device 100, there are no sheets of media T stacked on the main tray 114. As a result, the CPU 501 determines that the copy machine 1 is in the initial operation (YES). In this case, the processing advances to Step ST5.

If the copy machine 1 is not in the initial operation immediately subsequent to the operation of the post-processing device 100, there are sheets of media T stacked on the main tray 114. As a result, the CPU 501 determines that the copy machine 1 is not in the initial operation (NO). In this case, the processing advances to Step ST2.

Stacking Position Determination Processing (Step ST2)

In stacking position determination processing (Step ST2), the CPU 501 determines whether a position of a sheet of medium T to be stacked is different from a position of a sheet of medium T having been stacked on the main tray 114.

More specifically, if the copy machine 1 is not in the initial operation immediately subsequent to the operation of the post-processing device 100, there is at least one sheet of medium T stacked on the main tray 114. Accordingly, the CPU 501 determines whether a position of a sheet of medium T to be subsequently stacked is the same as a position of a sheet of medium T stacked on the main tray 114, or a topmost sheet of medium T in a bundle Ta (refer to FIGS. 14 and 15) or Tb (refer to FIG. 17) of sheets of media T.

More specifically, the CPU 501 determines whether the position of the sheet of medium T to be subsequently stacked is the same as the stacked position of the topmost sheet of medium T based on the number of copies or the number of sheets per copy acquired from the image forming apparatus main body control 2*a*.

If the position of the sheet of medium T to be subsequently stacked differs from the position of the sheet of medium T stacked immediately before, the CPU 501 determines that the stacked positions differ from each other (YES). In this case, the processing advances to Step ST3.

If the position of the sheet of medium T to be subsequently stacked is the same as the position of the sheet of medium T stacked immediately before, the CPU 501 determines that the stacked positions are the same (NO). In this case, the processing advances to Step ST4.

Processing to Move Alignment Members to Waiting Position (Step ST3)

In Step ST3, the CPU 501 performs processing to cause the alignment members 212, 214 to move to waiting positions, as shown in FIG. 10.

More specifically, the CPU 501 causes the alignment member rotational drive controller 504 and the shift drive controllers 505, 506 to operate, thereby causing the alignment members 212, 214 to move to the waiting position R2 (refer to FIG. 19) and the waiting position A (refer to FIG. 4). As shown in FIG. 19, the waiting position R2 is located above the feed plane F1 in the stacking direction Z. As a result, when the alignment members 212, 214 move to the waiting position R2, it is unlikely that the sheet of medium T fed in the feed direction F by the pair of feed rollers 113*b*, 113*c* comes into contact with the alignment members 212, 214 located at the waiting position R2.

In addition, the waiting position A is located further outwards in the shift direction Y than the fed sheet of medium T, as shown in FIG. 4. As a result, when the alignment members 212, 214 move to the waiting position A, it is unlikely that the sheet of medium T fed in the feed direction F by the pair of feed rollers 113*b*, 113*c* comes into contact with the alignment members 212, 214 located at the waiting position A.

Alignment Direction Confirmation Processing (Step ST4)

In Step ST4, the CPU 501 performs processing for alignment direction confirmation, as shown in FIG. 10. In other words, the CPU 501 determines whether the sheet of medium T to be subsequently stacked is aligned at a rear side position, based on the information related to the number of copies output from the image forming apparatus main controller 2*a*.

If the position of the sheet of medium T to be subsequently stacked is aligned at the rear side position (YES), the processing advances to Step ST5. On the other hand, if the position of the sheet of medium T to be subsequently stacked is not aligned at the rear side position (NO), the processing advances to Step ST7.

Rear Side Alignment Standby Processing (Step ST5)

In Step ST5, the CPU 501 performs the rear side alignment standby processing illustrated below, as shown in FIG. 10. In other words, the CPU 501 outputs a rotation signal to the alignment member rotational drive controller 504 so that the pair of alignment surfaces 216, 218 moves to the standby position R3 (refer to FIG. 12). The alignment member rotational drive controller 504 causes the alignment member rotational drive portion 230 to operate in accordance with the rotation signal output from the CPU 501.

Figure 13:
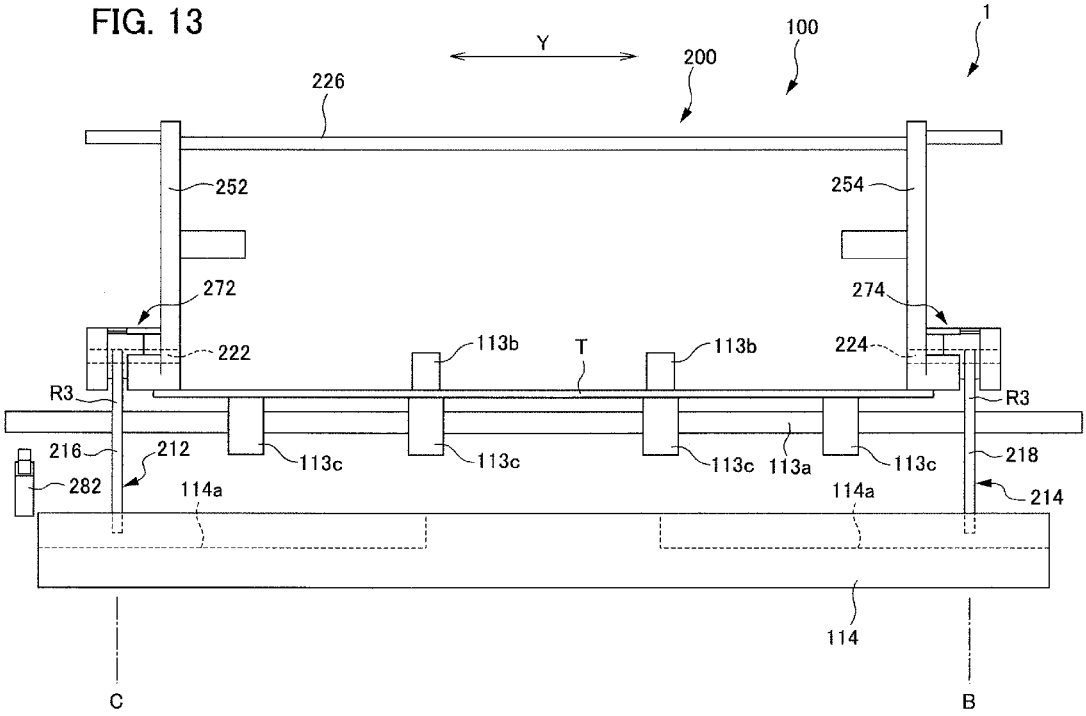
FIG. 13 is a schematic plan view of the post-processing device 100 shown in FIG. 12 when viewed from the direction of the arrow Z.

In addition, the CPU 501 outputs a movement signal to the shift drive controller 505, so that the alignment surface 216 moves to the standby position C (refer to FIG. 13). The shift drive controller 505 causes the shift drive portion 262 to operate in accordance with the movement signal output from the CPU 501. Similarly, the CPU 501 outputs a movement signal to the shift drive controller 506 so that the alignment member 218 moves to the alignment position B (refer to FIG. 13). The shift drive controller 506 causes the shift drive portion 264 to operate in accordance with the movement signal output from the CPU 501.

At this time, the distance between the alignment surface 216 disposed at the standby position C and the alignment surface 218 disposed at the alignment position B is larger than the dimension of a sheet of medium T to be stacked on the main tray 114 in the shift direction (direction of the arrow Y) (refer to FIG. 13).

Rear Side Alignment Processing (Step ST6)

Next, the CPU 501 performs the rear side alignment processing illustrated below in Step ST6, as shown in FIG. 10.

More specifically, the CPU 501 determines whether the timing at which a sheet of medium T has been fed to the main tray 114 is before the start timing for performing rear side alignment processing, based on the ON discharge detection signal S84 output by the sheet discharge detection sensor 384.

If the CPU 501 determines that the timing at which the sheet of medium T has been fed to the main tray 114 is after the start timing for performing rear side alignment processing, the CPU 501 does not perform the rear side alignment processing for this sheet of medium T.

If the CPU 501 determines that the timing at which the sheet of medium T has been fed to the main tray 114 is before the start timing for performing rear side alignment processing, the CPU 501 outputs an operation signal to the feed rotation shaft drive controller 503 based on the ON discharge detection signal S84. Accordingly, the feed rotation shaft drive controller 503 operates, causing the pair of feed rollers 113*b*, 113*c* to rotate. A sheet of medium T sandwiched between the pair of feed rollers 113*b*, 113*c* is stacked between the alignment surface 216 and the alignment surface 218 on the main tray 114. Simultaneously, the sheet counter 502 counts the number of sheets of media T stacked on the main tray 114.

Then, the CPU 501 outputs an operation signal to the shift drive controller 505 so as to cause the alignment surface 216 to move from the standby position C to the retaining position D (from the front side to the rear side in the direction of the arrow Y). Accordingly, the shift drive controller 505 causes the shift drive portion 262 to operate, thereby causing the alignment surface 216 to move from the standby position C to the retaining position D.

When the alignment surface 216 moves from the standby position C toward the retaining position D, the alignment surface 216 comes into contact with an end of the sheet of medium T in the shift direction (direction of the arrow Y). When the alignment surface 216 moves further towards the retaining position D, the alignment surface 216 pushes the sheet of medium T towards the alignment surface 218. Then, another end of the sheet of medium T opposite to the alignment surface 216 comes into contact with the alignment surface 218. The sheet of medium T moves to the rear side alignment position, as shown in FIG. 15.

Thereafter, the CPU 501 outputs an operation signal to the shift drive controller 505 so that the alignment surface 216 moves from the retaining position D towards the standby position C. The alignment surface 216 thereby moves from the retaining position D towards the standby position C, as shown in FIG. 13.

Figure 14:
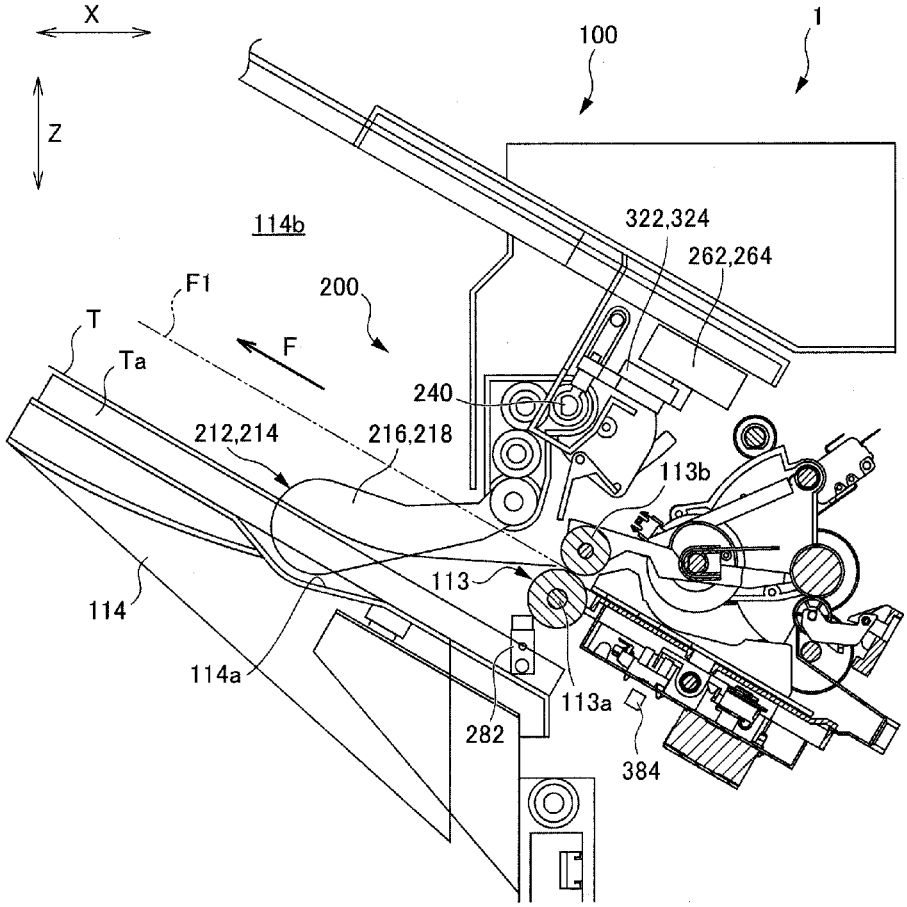
FIG. 14 is a vertical cross-sectional view illustrating operation of the post-processing device 100 continued from FIG. 12.
Figure 15:
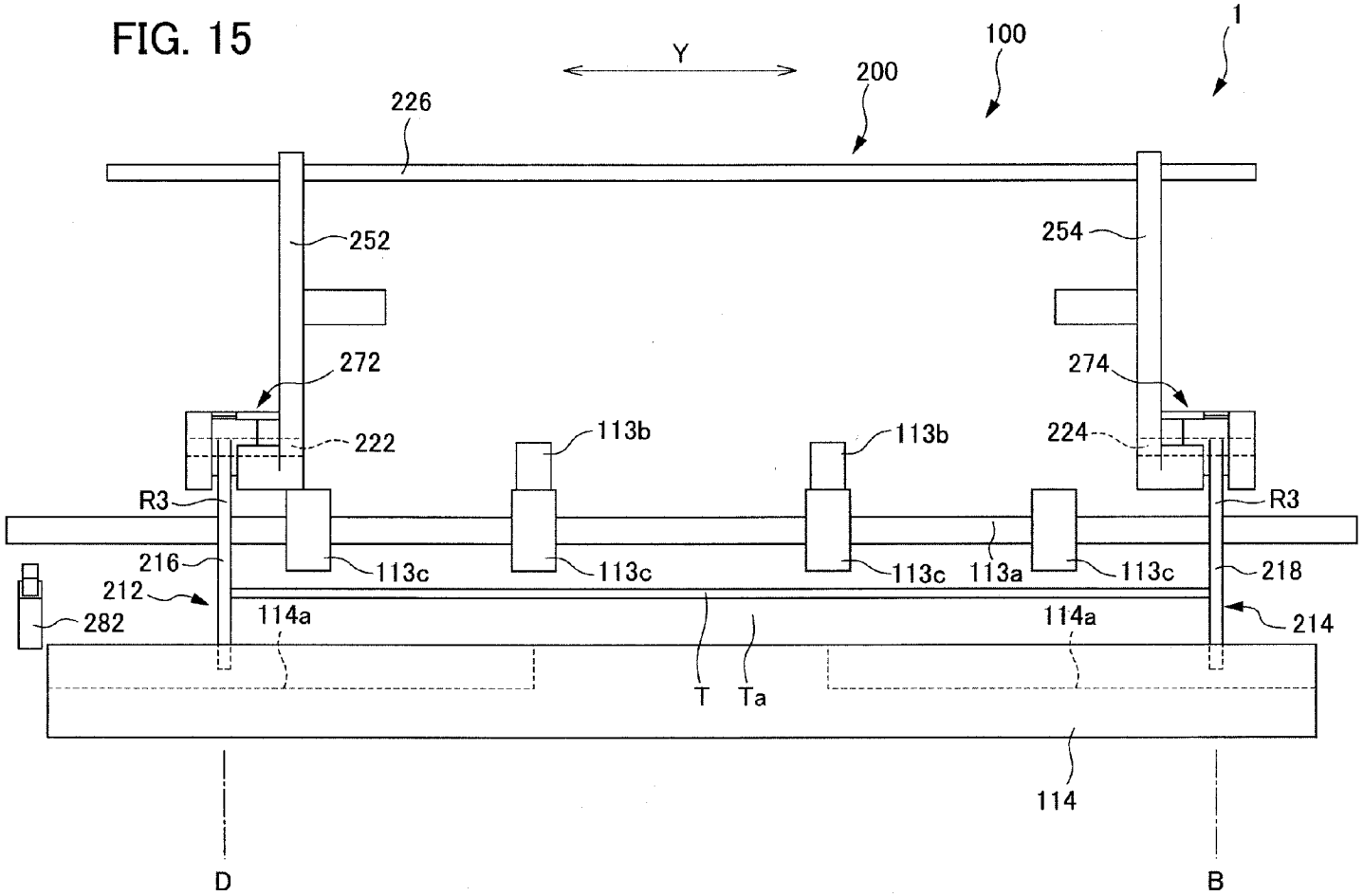
FIG. 15 is a schematic plan view of the post-processing device 100 shown in FIG. 14 when viewed from the direction of the arrow Z.

In this way, when a plurality of sheets of media T are stacked on the main tray 114, a bundle Ta made up of the plurality of sheets of media T is formed on the main tray 114, as shown in FIGS. 14 and 15.

After Step ST6, the processing advances to Step ST9.

Front Side Alignment Standby Processing (Step ST7)

If the position of a sheet of medium T to be subsequently stacked is not the rear side position in Step ST4 (NO), the CPU 501 performs the front side alignment standby processing illustrated below in Step ST7, as shown in FIG. 10. It should be noted that the explanation for operations similar to the rear side alignment standby processing (Step ST5) will not be repeated.

The CPU 501 outputs a rotation signal to the alignment member rotational drive controller 504 so that the pair of alignment surfaces 216, 218 moves to the standby position R3 (refer to FIG. 12).

Figure 16:
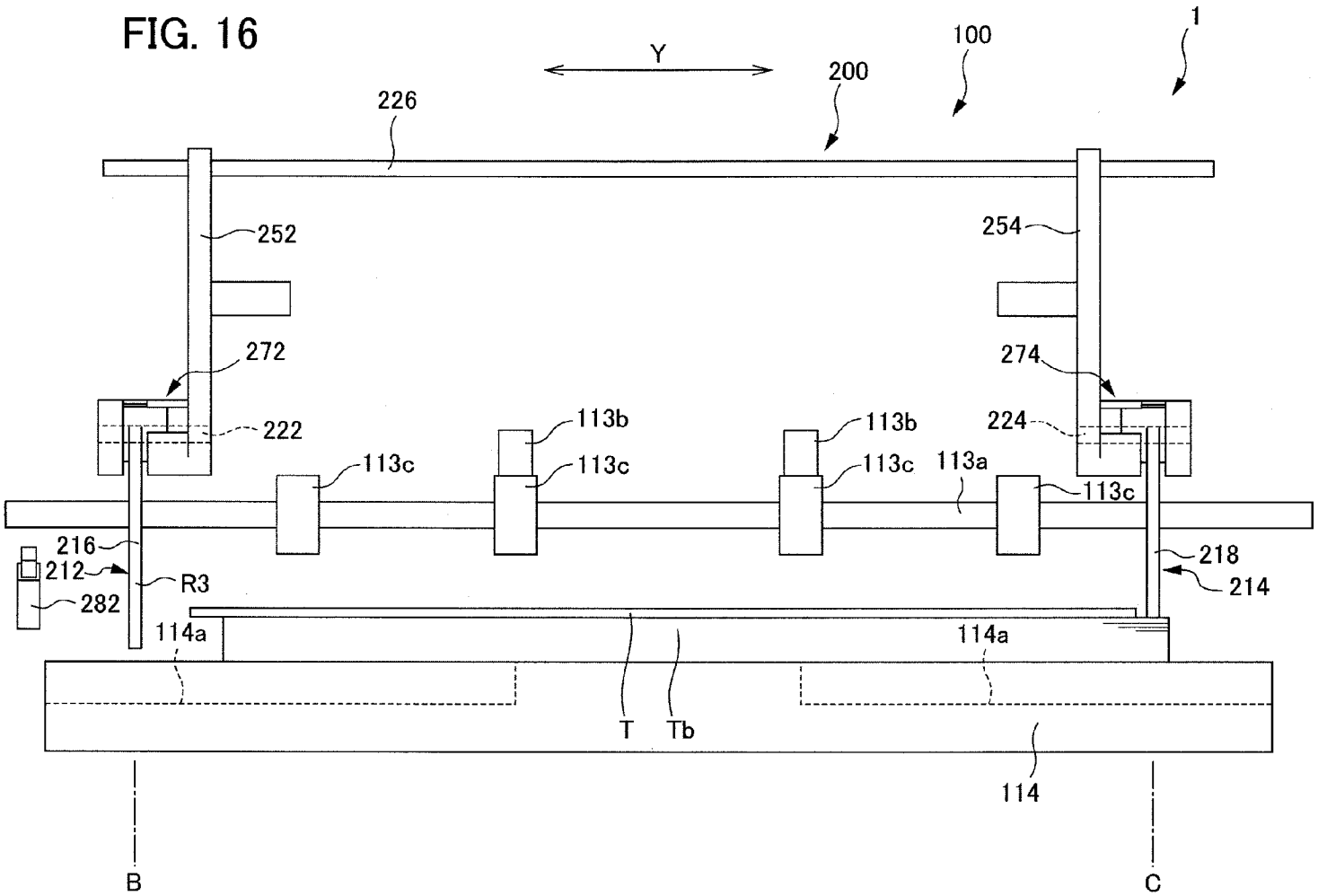
FIG. 16 is a schematic plan view illustrating operation of the post-processing device 100 continued from FIG. 14, when viewed from the direction of the arrow Z.

In addition, the CPU 501 outputs a movement signal to the shift drive controller 505 so that the alignment surface 216 moves to the alignment position B (refer to FIG. 16). The shift drive controller 505 causes the shift drive portion 262 to operate in accordance with the movement signal output from the CPU 501. Similarly, the CPU 501 outputs a movement signal to the shift drive controller 506 so that the alignment surface 218 moves to the standby position C (refer to FIG. 16). The shift drive controller 506 causes the shift drive portion 264 to operate in accordance with the movement signal output from the CPU 501.

At this time, the distance between the alignment surface 216 disposed at the alignment position B and the alignment surface 218 disposed at the standby position C is larger than the dimension in the shift direction (direction of the arrow Y) of sheet of medium T to be stacked on the main tray 114 (refer to FIG. 16). In addition, the bundle Ta of sheets already aligned in the rear side alignment processing is stacked between the alignment surface 216 disposed at the alignment position B and the alignment surface 218 disposed at the standby position C.

Figure 18:
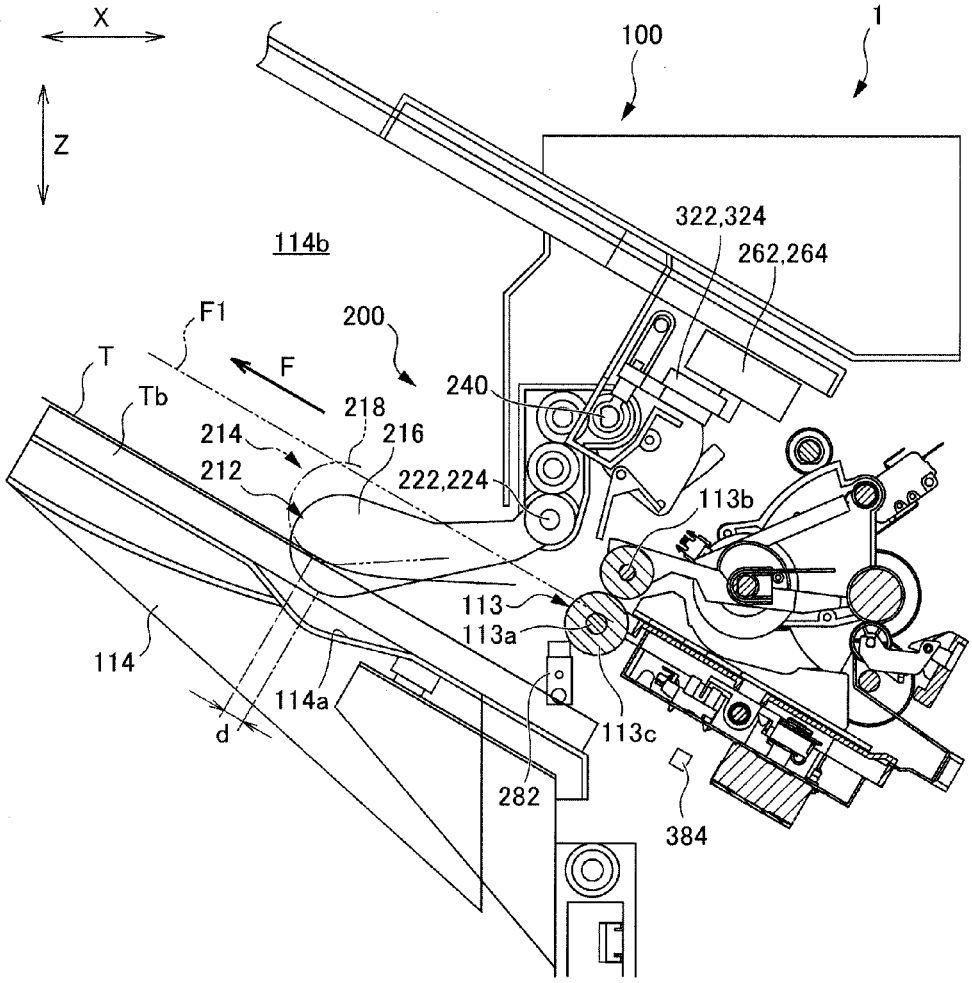
FIG. 18 is a vertical cross-sectional view illustrating the post-processing device 100 in detail shown in FIG. 17.

At this time, the alignment surface 216 does not ride on the top of the bundle Tb of sheets, but the alignment surface 218 rides on the top of the bundle Tb of sheets, as shown in FIG. 18. The bundle Tb of sheets is stacked on the bundle Ta of sheets at a position shifted in the shift direction Y relative to the bundle Ta of sheets.

It should be noted that the one hub 275 is rotatably connected to the other hub 276 by a predetermined angle (in the present embodiment, approximately 90°, which is ¼ of 360°). Accordingly, the alignment surface 218 rotates by the predetermined angle (approximately 90°) relative to the alignment member rotation shaft 224.

As a result, the alignment surface 218 rotationally moves upwards by the dimension of the thickness of the bundle Tb of sheets in the stacking direction (direction of the arrow Z), as shown in FIG. 18. At this time, the position of the alignment member rotation shaft 224 with respect to the stacking direction (direction of the arrow Z) is located in the vicinity of the feed plane F1. As a result, the alignment surface 218 extends from the alignment member rotation shaft 224 substantially in parallel with the feed plane F1. Consequently, the alignment surface 218 experiences almost no rotation.

In other words, the relative displacement d between the alignment surfaces 216 and 218 in the feed direction F is less than a relative displacement, which occurs when the alignment surface 218 extending from the alignment member rotation shaft 224 intersects with the feed plane F1 at a larger angle. Since the end of the sheet of medium T is pushed under an almost constant condition, it is possible to perform consistent alignment of the sheet of medium T. In other words, the alignment surfaces 216, 218 neatly align a lateral face of the bundle of sheets of media T in the shift direction Y.

In addition, a surface of stacked sheet of medium T is normally a planar shape extending in the feed direction F;

however, when a plurality of sheets of media T is stacked, a top surface of the sheets of media T may become a curved shape. When the top surface of the sheets of media T becomes curved, the dimension in the stacking direction (direction of the arrow Z) of the stacked sheets of media T becomes slightly larger.

Since the alignment surface 218 extends from the alignment member rotation shaft 224 substantially in parallel with the feed direction F1, the alignment surface 218 experiences almost no rotation. In other words, the alignment surfaces 216, 218 neatly align a lateral face of a bundle of sheets of media T in the shift direction Y, even if the sheets of media T in a curved shape are stacked.

Front Side Alignment Processing (Step ST8)

Next, the CPU 501 performs the front side alignment processing illustrated below in Step ST8, as shown in FIG. 10.

More specifically, the CPU 501 determines whether the timing at which a sheet of medium T has been fed to the main tray 114 is before the start timing for performing front side alignment processing, based on the ON discharge determination signal S84 output by the sheet discharge detection sensor 384.

If the CPU 501 determines that the timing at which the sheet of medium T has been fed to the main tray 114 is after the start timing for performing front side alignment processing, the CPU 501 does not perform the front side alignment processing for this sheet of medium T.

If the CPU 501 determines that the timing at which the sheet of medium T has been fed to the main tray 114 is before the start timing for performing front side alignment processing, the CPU 501 outputs an operation signal to the feed rotation shaft drive controller 503, causing the feed rotation shaft drive controller 503 to operate. In addition, the sheet counter 502 counts the number of sheets of media T stacked on the main tray 114, similarly to the rear side alignment processing (Step ST3).

Then, the CPU 501 outputs an operation signal to the shift drive controller 506 so as to cause the alignment surface 218 to move from the standby position C to the retaining position D (from the rear side to the front side in the direction of the arrow Y). Accordingly, the shift drive controller 506 causes the shift drive portion 264 to operate, thereby causing the alignment surface 218 to move from the standby position C to the retaining position D.

Figure 17:
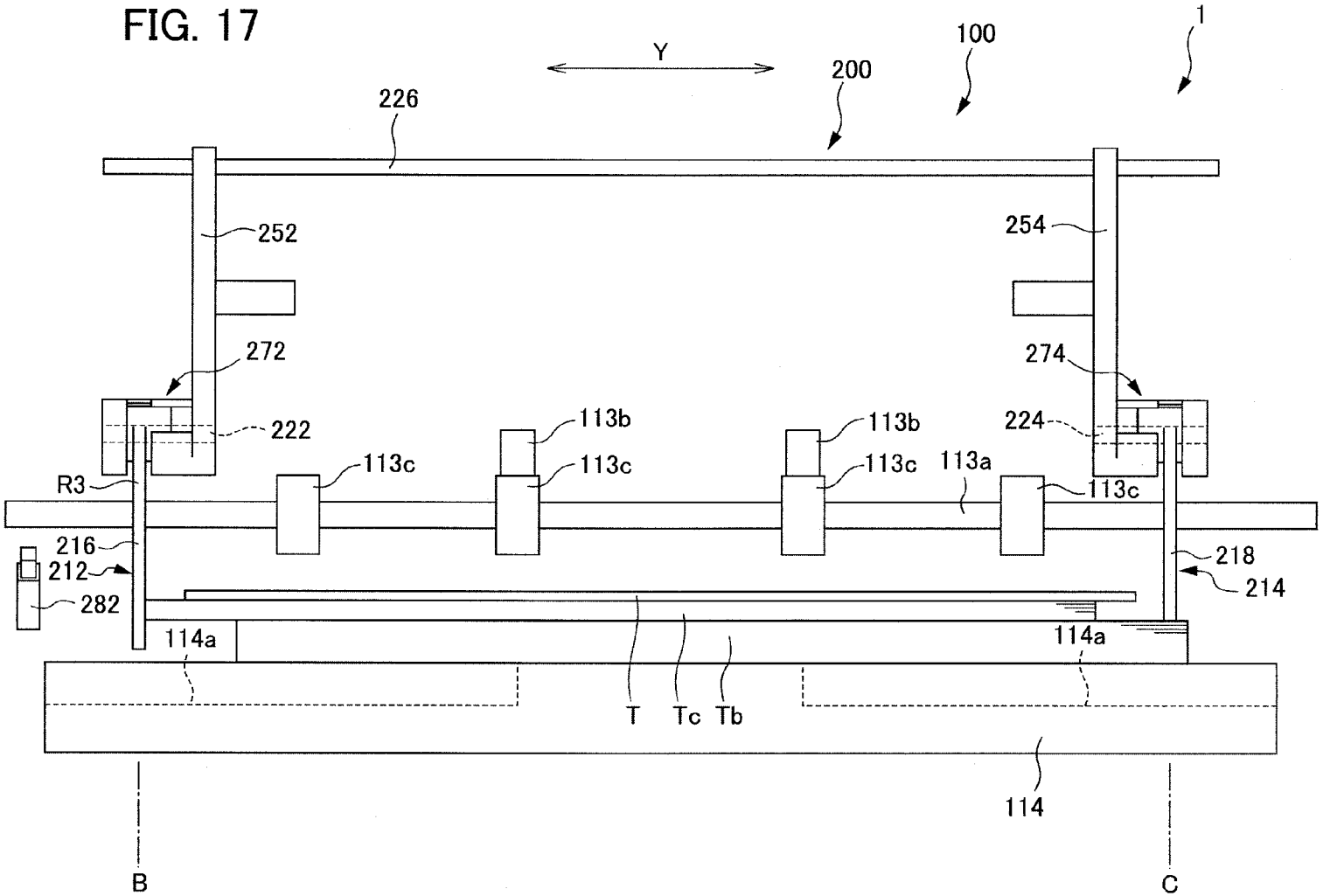
FIG. 17 is a schematic plan view illustrating operation of the post-processing device 100 continued from FIG. 16, when viewed from the direction of the arrow Z.

When the alignment surface 218 moves from the standby position C towards the retaining position D, the alignment surface 218 comes in contact with an end of a sheet of medium T in the shift direction (direction of the arrow Y). When the alignment surface 218 moves further towards the retaining position D, the alignment surface 218 pushes the sheet of medium T towards the alignment surface 216. Then, another end of the sheet of medium T on opposite to the alignment surface 218 comes into contact with the alignment surface 216. The sheet of medium T moves to the front side alignment position, as shown in FIG. 17.

Afterwards, the CPU 501 outputs a movement signal to the shift drive controller 506 so as to cause the alignment surface 218 to move from the retaining position D towards the standby position C. In this manner, the alignment surface 218 moves from the retaining position D towards the standby position C, as shown in FIG. 17.

After Step ST8, the processing advances to Step ST9.

Tray Descend Determination Processing (Step ST9)

As shown in FIG. 10, after Step ST6 or Step ST8, the CPU 501 executes the tray descend determination processing illustrated below in Step ST9.

More specifically, the CPU 501 determines whether the position of a topmost sheet of medium T in the stacking direction (direction of the arrow Z) of sheets of media T stacked on the main tray 114 exceeds a predetermined position.

In other words, the loading sensor 282 outputs an ON loading signal S82 to the CPU 501 when the topmost position of the sheets of media T stacked on the main tray 114 has reached the predetermined position relative to the post-processing device main body M. When the CPU 501 receives the ON loading signal S82 output from the loading sensor 282, the CPU 501 determines that the position of the topmost sheet of medium T has exceeded the predetermined position. When the CPU 501 receives the OFF loading signal S82 output from the loading sensor 282, the CPU 501 determines that the position of the topmost sheet of medium T has not exceeded the predetermined position.

If the position of the topmost sheet of medium T has exceeded the predetermined position (YES), the processing advances to Step ST10.

If the position of the topmost sheet of medium T has not exceeded the predetermined position (NO), the processing advances to Step S11.

Tray Descend Processing (Step ST10)

In Step ST10, the CPU 501 executes the tray descend processing illustrated below, as shown in FIG. 10. The CPU 501 outputs a descend signal to the tray controller 507 so as to lower the main tray 114 by a predetermined amount. The tray controller 507 controls the tray ascend/descend movement drive portion 292 so as to cause the main tray 114 to descend by the predetermined amount (from the state of the main tray 114 shown in FIG. 16 to the state of the main tray 114 shown in FIG. 17), in accordance with the descend signal.

Continuation Determination Processing (Step ST11)

In Step ST11, the CPU 501 executes the continuation determination processing illustrated below, as shown in FIG. 10. More specifically, the CPU 501 makes the determination based on a continuation signal output from the image forming apparatus main controller 2*a*. The continuation signal includes information related to whether the image forming apparatus main body 2 is performing image formation.

If the CPU 501 determines that image formation is continuing (YES), the processing returns to Step ST2. If the CPU 501 determines that image formation is not continuing (NO), the CPU 501 outputs a control signal to the aligning part rotation shaft controller 504 and the shift drive controllers 505, 506 so as to cause the pair of alignment surfaces 216, 218 to move to the stored position R1 and the waiting position A.

When the pair of alignment surfaces 216, 218 has moved to the stored position R1 and the waiting position A, the post-processing device 100 stops. The processing thereby ends.

Error Occurrence Case

When the post-processing device 100 is operating, a trouble may occur, in which a user touches the alignment surfaces 216, 218. Since the alignment member rotational drive portion 230 and the shift drive controllers 505, 506 are stepping motors, a so-called step-out phenomenon in which an output shaft will not rotate in accordance with a pulse signal may arise in such a case. When the alignment member rotational drive portion 230 and the shift drive controllers 505, 506 undergo this step-out phenomenon, a shift in a rotational direction occurs between a main body and an output shaft with respect to each of the alignment member rotational drive portion 230 and the shift drive controllers 505, 506.

Figure 11:
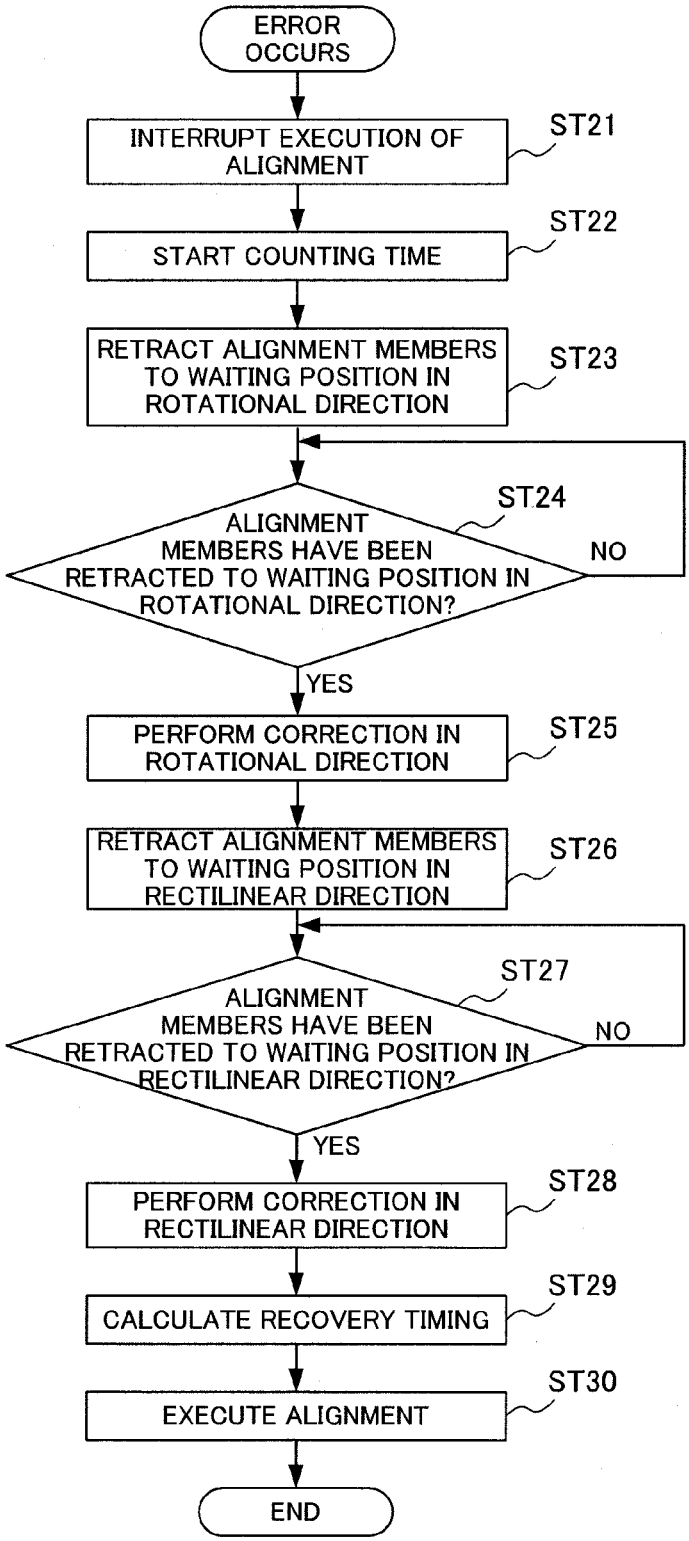
FIG. 11 is a flowchart illustrating operations of the post-processing device 100 for a case of occurrence of an error during the operation of the post-processing device 100 shown in FIG. 10.

As shown in FIG. 11, if the CPU 501 detects such an error as an interrupt signal, the CPU 501 immediately suspends the execution of each processing from Step ST1 to Step ST11 (alignment execution stop processing (Step ST21)). However, the CPU 501 does not cause the operation of the image forming apparatus main body 2 to stop. Although the operation of the sheet aligning mechanism 200 temporarily stops thereby, the operation of forming images on sheets of media T in the image forming apparatus main body 2 is continued. Therefore, a sheet of medium T to be stacked on the main tray 114 after the detection of the interrupt signal is not aligned by the sheet aligning mechanism 200.

In addition, the CPU 501 causes the timer 508 to start counting time (Counting Time Start Processing (Step ST22)).

Then, in Step ST23, the CPU 501 outputs a waiting signal to the alignment member rotational drive portion 230 and shift drive controllers 505, 506 so as to cause the alignment surfaces 216, 218 to move to the waiting position R2 and the waiting position A (rotational-direction waiting execution processing), as shown in FIG. 19.

When the alignment member rotational drive portion 230 operates accordingly, the alignment surfaces 216, 218 move to the waiting position R2. As a result, the rotation disk 316 of the rotation detection mechanism 310 rotates, and the waiting confirmation cutout 316*a* rotationally moves to the position of the waiting confirmation sensor 312.

In Step ST24, the CPU 501 determines whether the alignment surfaces 216, 218 have moved to the waiting position R2, based on the waiting signal S12 output from the waiting confirmation sensor 312 (rotational direction waiting determination processing).

If the alignment surfaces 216, 218 have not moved to the waiting position R2, the waiting confirmation sensor 312 outputs an OFF waiting signal S12 to the CPU 501 since the waiting confirmation cutout 316*a* has not moved to the position of the waiting confirmation sensor 312. Since the CPU 501 receives the OFF waiting signal S12, the CPU 501 determines that the alignment surfaces 216, 218 have not moved to the waiting position R2 (NO), and repeats Step ST24.

When the CPU 501 repeats Step ST24, the waiting confirmation cutout 316*a* moves to the position of the waiting confirmation sensor 312. Accordingly, the waiting confirmation sensor 312 outputs an ON waiting signal S12 to the CPU 501. Since the CPU 501 receives the ON waiting signal S12, the CPU 501 determines that the alignment surfaces 216, 218 have moved to the waiting position R2 (YES). The processing advances to Step ST25.

In Step ST25, when the waiting confirmation cutout 316*a* has rotationally moved to the position of the waiting confirmation sensor 312, the waiting confirmation sensor 312 outputs the ON waiting signal S12 to the CPU 501 of the post-processing controller 500. In this manner, the alignment member rotational drive portion 230 of the rotational movement drive mechanism 300 corrects the shift between the alignment member rotational drive portion 230 and its output shaft (rotational direction correction execution processing).

More specifically, while causing the alignment members 212, 214 to move to the waiting position R2, the CPU 501 waits for the ON waiting signal S12 to be input to the CPU 501.

When the CPU 501 confirms the input of the ON waiting signal S12 within a predetermined period of time, based on the timing signal generated by the timer 508, the CPU 501 determines that the alignment members 212, 214 are at the controlled positions.

However, if the CPU 501 does not confirm the input of the ON waiting signal S12 within the predetermined period of time based on the timing signal generated by the timer 508, the CPU 501 determines that the alignment members 212, 214 are not at the controlled positions.

Then, the CPU 501 performs a corrective action for the positions of the alignment members 212, 214. The corrective action is executed by causing the alignment members 212, 214 to rotate around the alignment member rotation shafts 222, 224 so that the ON waiting signal S12 is input to the CPU 501.

When the ON waiting signal S12 is input to the CPU 501, the CPU 501 sets the positions of the alignment member rotation shafts 222, 224 at a time of the input as a waiting position R2.

In addition, when the shift drive controllers 505, 506 operate in Step ST26, the alignment surfaces 216, 218 move to the waiting position A (rectilinear waiting execution processing). The pair of guide bases 252, 254 thereby moves in the shift direction (direction of the arrow Y), and the guide base 252 (265) moves in parallel to the position of the rectilinear waiting position detector 342 (344).

In addition, when the guide base 252 (254) moves in parallel to the position of rectilinear waiting position detector 342 (344), the rectilinear waiting position detector 342 (344) outputs an ON standby detection signal S42 (S44) to the CPU 501 of the post-processing controller 500, respectively.

In Step ST27, the CPU 501 determines whether the alignment surface 216 (218) has moved to the waiting position A, based on the standby detection signal S42 (S44) output from the rectilinear waiting position detector 342 (344) (rectilinear waiting determination processing).

If the alignment surfaces 216, 218 have not moved to the waiting position A, the rectilinear waiting position detector 342 (344) outputs an OFF standby detection signal S42 (S44) to the CPU 501. Since the CPU 501 receives the OFF standby detection signals S42, S44, the CPU 501 determines that the alignment surfaces 216, 218 have not moved to the waiting position A (NO). Step ST27 is then repeated.

When Step ST27 is repeated, the alignment surfaces 216, 218 move to the waiting position A. Then, when the alignment surface 216 (218) has moved to the waiting position A, the rectilinear waiting position detector 342 (344) outputs an ON standby detection signal S42 (S44) to the CPU 501. Since the CPU 501 receives the ON standby detection signals S42, S44, the CPU 501 determines that the alignment surfaces 216, 218 have moved to the waiting position A (YES). Then, the processing advances to Step ST28.

In Step ST28, the CPU 501 corrects the shift between the shift drive controllers 505, 506 and their outputs shafts (rectilinear correction execution processing).

More specifically, while causing the alignment member 212 (214) to move to the waiting position A, the CPU 501 waits for the ON standby detection signal S42 (S44) to be input to the CPU 501.

When the CPU 501 confirms the input of the ON standby detection signals S42, S44 within a predetermined period of time, based on the timing signal of the timer 508, the CPU 501 determines that the alignment members 212, 214 are at the controlled positions.

However, if the CPU 501 does not confirm the input of the ON standby detection signals S42, S44 within the predetermined period of time, based on the timing signal of the timer 508, the CPU 501 determines that the alignment members 212, 214 are not at the controlled positions.

Then, the CPU 501 performs a corrective action to correct positions of the alignment members 212, 214. The corrective action causes the alignment member 212 (214) to undergo a reciprocating motion in the shift direction, so that the ON standby detection signal S42 (S44) is input to the CPU 501, for example.

When the ON waiting signal S42 (S44) is input to the CPU 501, the CPU 501 sets the position of the alignment member rotation shaft 222 (224) at a time of receiving the input as a waiting position A.

The CPU 501 calculates a waiting movement time, covering from a time at which the error has been detected until a time at which the alignment members 212, 214 have finished moving to the waiting position R2, based on a timing signal output from the timer 508.

In Step ST29, the CPU 501 calculates timing to resume execution of each processing of Steps ST1 to ST9, based on the waiting movement time and the image formation cycle of the image forming apparatus main body 2 (recovery timing calculation processing).

In Step ST30, the CPU 501 executes each processing of Steps ST1 to ST11 based on the timing thus calculated (recovery processing).

Under this circumstance, it may be that sheets of media T, which are not aligned according to the rear side alignment processing (Step ST5) or the front side alignment processing (Step ST7), are stacked on the main tray 114 depending on time at which Steps ST21 to ST29 are executed. In other words, although the operation of the sheet aligning mechanism 200 stops, the operation of forming images on the sheets of media T in the image forming apparatus main body 2 continues. As a result, the sheets of media T stacked on the main tray 114 after an interrupt signal is detected are not aligned by the sheet aligning mechanism 200.

However, since the alignment surfaces 216, 218 exert a force sufficient for pressing a plurality of sheets of media, the sheets of media T not yet aligned are aligned together with sheets of media T newly stacked through the resumed rear side alignment processing (Step ST5) or the front side alignment processing (Step ST7).

Herein, the timing at which the CPU 501 executes recovery processing is exemplified as follows.

For example, if the alignment members 212, 214 have not moved to the waiting position A when the trailing end of a sheet of medium T in the feed direction F has passed the detection position of the sheet ejection detection sensor 384, the CPU 501 does not execute alignment operation for this sheet of medium T. Then, after the CPU 501 causes the alignment members 212, 214 to move to the waiting position A, the CPU 501 executes recovery processing to align a sheet of medium T fed subsequent to this sheet of medium T.

In addition, if the alignment members 212, 214 have neither moved to the waiting position A nor rotationally moved to the waiting position R2 when the trailing end of a sheet of medium T in the feed direction F has passed the detection position of the sheet discharge detection sensor 384, the CPU 501 does not execute the alignment operation for this sheet of medium T. Then, after the CPU 501 causes the alignment members 212, 214 to move to the waiting position R2, the CPU 501 executes recovery processing to align a sheet of medium T fed subsequent to this sheet of medium T.

Effects of Post-Processing Device 100

The following effects are exerted by the post-processing device 100 and copy machine 1 according to the present embodiment, for example.

The copy machine 1 according to the present embodiment includes the pair of feed rollers 113*b*, 113*c* that interposes a sheet of medium T fed thereto and feeds the sheet of medium T in the feed direction F; the main tray 114 on which sheets of media T fed by the pair of feed rollers 113*b*, 113*c* are stacked in the stacking direction (direction of the arrow Z); and the sheet aligning mechanism 200 that aligns the sheet of medium T thus stacked by causing it to move in the shift direction (direction of the arrow Y), which is orthogonal to the feed direction F and the stacking direction. The sheet aligning mechanism 200 has the pair of alignment members 212, 214; the pair of alignment member rotation shafts 222, 224; the alignment member rotational drive portion 230; the guide rail 226; the pair of guide bases 252, 254; and the pair of base conveying mechanisms 320*a*, 320*b*. The alignment member 212 (214) has the alignment surface 216 (218) that extends in the stacking direction into the region 114*b* above the main tray 114 and aligns the ends of the sheet of medium T in the shift direction (direction of the arrow Y). The alignment member rotation shaft 222 (224) rotatably supports the alignment surface 216 (218) in the region 114*b* of the main tray 114 on a side on which the sheets of media T are stacked in the stacking direction. The alignment member rotational drive portion 230 causes the alignment surface 216 (218) to rotate around the alignment member rotation shaft 222 (224). The guide rail 226 is disposed opposite to the main tray 114 relative to the pair of alignment member rotation shafts 222, 224 in the stacking direction of the sheet of medium T, and extends in the shift direction (direction of the arrow Y). The pair of guide bases 252, 254 is movably attached to the guide rail 226 in the shift direction (direction of the arrow Y). The alignment surface 216 (218) and the alignment member rotation shaft 222 (224) are attached to the guide base 252 (254). The base conveying mechanism 320*a* (320*b*) causes the guide base 252 (254) to move in the shift direction (direction of the arrow Y). The alignment member rotation shaft 222 (224) is attached to the base conveying mechanism 320*a* (320*b*) in the stacking direction so as to be located in the vicinity of the feed plane F1, which is a virtual plane in which the lower portion of the alignment member rotation shaft 222 (224) extends from the pair of feed rollers 113*b*, 113*c* in the feed direction F.

According to the copy machine 1 of the present embodiment, when the number of sheets of media T stacked on the main tray 114 increases, the position of the alignment surfaces 216, 218 relative to the main tray 114 moves upwards in the stacking direction. However, since the alignment member rotation shaft 222 (224) is in the vicinity of the feed plane F1, the alignment surface 216 (218) extends from the alignment member rotation shaft 222 (224) substantially in parallel with the feed plane F1. As a result, the pair of alignment surfaces 216, 218 experiences almost no rotation, even when the number of sheets of media T increases. Therefore, according to the copy machine 1 of the present embodiment, the pair of alignment members 212, 214 tends not to move in the feed direction, even if the dimension in the stacking direction of the sheets of media T stacked on the main tray 114 changes.

According to the copy machine 1 of the present embodiment, the pair of alignment member rotation shafts 222, 224 is disposed above the feed plane F1.

As a result, a sheet of medium T fed from the pair of feed rollers 113*b*, 113*c* moves below the feed plane F1 due to gravity. Accordingly, the sheet of medium T fed from the pair of feed rollers 113*b*, 113*c* tends not to come into contact with the pair of alignment member rotation shafts 222, 224.

The alignment member 212 (214) has the coupling 272 (274) that turns around the alignment member rotation shaft 222 (224). Each of the pair of couplings 272, 274 is configured so that the other hub 276 rotates following the operation of the alignment member rotational drive portion 230. The coupling 272 (274) has the pair of hubs 275, 276 that is rotatably coupled to each other by a predetermined angle in the rotational direction of the alignment member rotation shaft 222 (224). The alignment surface 216 (218) is unrotatably attached to one of the pair of hubs 275, 276 of the coupling 272 (274). The alignment member rotational drive portion 230 causes the other of the pair of hubs 275, 276 to rotate, the pair of hubs 275, 276 being included in each of the pair of couplings 272, 274.

As a result, the alignment surface 216 (218) is freely rotatable by a predetermined angle in the rotational direction by way of the coupling 272 (274). Even if the amount of sheets of media T stacked on the main tray 114 changes, the present embodiment is adaptable to a change in the amount through the predetermined angle for which free rotation is allowed.

The post-processing device 100 includes the tray movement mechanism that causes the main tray 114 to move in the stacking direction; the sheet passage detector (sheet discharge detection sensor 384) that detects the passage of a sheet of medium T to be stacked on the main tray 114; the sheet counter 502 that counts the number of sheets of media T stacked based on the detection signal generated by the sheet passage detector (sheet discharge detection sensor 384); and the tray controller 507 that causes the tray movement mechanism to operate so as to cause the main tray 114 to descend in the stacking direction, in accordance with the number of sheets counted by the sheet counter 502.

The post-processing device 100 includes the tray movement mechanism that causes the main tray 114 to move in the stacking direction; the sheet loading detector (loading sensor 282) that detects the presence of a sheet of medium T stacked on the main tray 114; the sheet position calculator 509 that calculates the height position of sheets of media T stacked on the main tray 114 based on the loading signal S82 generated by the sheet loading detector (loading sensor 282); and the tray controller 507 that causes the tray movement mechanism to operate so as to cause the main tray 114 to descend in the stacking direction, based on the information on the position of the sheets of media detected by the sheet position calculator 509.

It is possible to cause the main tray 114 to descend depending on the amount of sheets of media T stacked on the main tray 114, so that the pair of alignment surfaces 216, 218 is located substantially in parallel with the feed plane F1.

The sheet aligning mechanism 200 includes the rotational movement drive mechanism 300, the rotational waiting position detector (rotation detection mechanism 310), the waiting position detector (rectilinear waiting position detectors 342, 344), and the post-processing controller 500. The rotational movement drive mechanism 300 causes the alignment members 212, 214 to rotate around the rotation shafts (alignment member rotation shafts 222, 224) extending in the shift direction (direction of the arrow Y), and to move in the shift direction (direction of the arrow Y). The rotation detection mechanism 310 detects that the alignment members 212, 214 have moved to the rotational waiting position (waiting position R2) at which the alignment members wait. The waiting position R2 is a part of the rotational range (stored position R1-waiting position R2-standby position R3) around the rotation shafts (alignment member rotation shafts 222, 224) extending in the shift direction (direction of the arrow Y). The rectilinear waiting position detector 342 (344) detects that the alignment member 212 (214) has moved to the rectilinear waiting position (waiting position A) at which the alignment member 212 (214) stands by. The waiting position A is a part of the movement range (waiting position A-alignment position B-standby position C-retaining position D) in the shift direction (direction of the arrow Y) in which the alignment member 212 (214) shifts. The post-processing controller 500 causes the rotational movement drive mechanism to perform correction of the rotational angle and amount of the movement of the alignment members 212, 214 based on the detection signals output from the rotational waiting position detector and the rectilinear waiting position detector.

As a result, it is possible for the post-processing device 100 to carry out correction on the rotational movement drive mechanism 300 in a state in which the alignment members 212, 214 have moved to the waiting position. Therefore, the positions of the pair of alignment members 212, 214 will not easily shift from the objective position to be controlled.

The rotational waiting position is above, in the stacking direction, the feed plane F1, which is a virtual plane extending from the pair of feed rollers 113*b*, 113*c* in the feed direction F. In addition, the rectilinear waiting position is further outwards, in the shift direction (direction of the arrow Y), than both ends of a sheet of medium T fed from the pair of feed rollers 113*b*, 113*c*.

As a result, the rotational and rectilinear waiting positions of the alignment members 212, 214 are outside the range in which the sheet of medium T fed from the pair of feed rollers 113*b*, 113*c* moves.

The post-processing device 100 includes the sheet passage detector (sheet discharge detection sensor 384) that detects the passage of a sheet of medium T to be stacked on the main tray 114. The post-processing controller 500 performs correction on the rotational movement drive mechanism based on the detection signal output from the sheet passage detector.

As a result, it is possible to perform correction of the rotational movement drive mechanism 300 when the sheet of medium T is not being fed from the pair of feed rollers 113*b*, 113*c*.

Alternative Embodiments

Although a preferred embodiment of the present invention has been explained in the foregoing, the present invention is not to be limited to the aforementioned embodiment. The present invention can be employed in various forms.

In the tray descend processing (Step ST8), the CPU 501 detects the position of the topmost sheet of medium T using the loading sensor 282; however, it is not limited thereto. For example, the CPU 501 may be configured to cause the sheet counter 502 to count the number of sheets of media T stacked on the main tray 114, and when the number exceeds a predetermined number of sheets, the CPU 501 may control the tray controller 507 to cause the main tray 114 to descend.

The type of the post-processing device is not particularly limited, and may include arbitrary types as long as they perform various types of post-processing on a sheet of medium.

The type of the image forming apparatus 1 is not particularly limited, and may include a copy machine, a printer, a fax machine, or a multi-functional device incorporating these functions.

The sheet of medium T may include paper and a film sheet, for example.

What is claimed is:

1. A post-processing device, comprising:

a pair of feed rollers configured to feed a sheet of medium in a feed direction while sandwiching the sheet of medium therebetween;

a tray configured to stack the sheet of medium fed by the pair of feed rollers in a stacking direction; and a sheet aligning mechanism configured to cause the sheet of medium stacked on the tray to move in a shift direction perpendicular to the feed direction and the stacking direction, such that the sheet of medium is aligned, wherein the sheet aligning mechanism comprises:

a pair of alignment members including a pair of alignment surfaces configured to push an end of the sheet of medium in the shift direction, the pair of alignment surfaces extending into a region above the tray in the stacking direction;

an alignment member support configured to support the pair of alignment members such that each of the pair of alignment members is rotatable about a rotation shaft extending in the shift direction and rectilinearly movable in the shift direction, within a region on a side closer to the sheet of medium stacked on the tray with respect to the stacking direction;

a driving mechanism configured to cause the pair of alignment members to rotate about the rotation shaft extending in the shift direction and to rectilinearly move in the shift direction;

a first detector configured to detect whether the pair of alignment members has moved to a rotational waiting position provided for the pair of alignment members, the rotational waiting position being a part of a rotational range in which the pair of alignment members is rotatable about the rotation shaft extending in the shift direction;

a second detector configured to detect whether the pair of alignment members has moved to a rectilinear waiting position provided for the pair of alignment members, the rectilinear waiting position being a part of a rectilinear range in which the pair of alignment members is movable in the shift direction; and a post-processing controller configured to cause the driving mechanism to correct a rotational angle and an amount of rectilinear movement based on signals sent from the first detector and the second detector, wherein one rotation shaft about which one of the air of alignment embers rotates is configured to be spaced away a distance from the other rotation shaft about which the other one of the pair of alignment members rotates.

2. The post-processing device according to claim 1, wherein the rotational waiting position lies above a feeding plane in the stacking direction, the feeding plane being a virtual plane that extends from the pair of feed rollers in the feed direction.

3. The post-processing device according to claim 2, wherein the rectilinear waiting position lies in the shift direction outside both ends of the sheet of medium fed from the pair of feed rollers.

4. The post-processing device according to claim 1, wherein the rectilinear waiting position lies in the shift direction outside both ends of the sheet of medium fed from the pair of feed rollers.

5. The post-processing device according to claim 1, wherein the sheet aligning mechanism further comprises a third detector configured to detect passage of the sheet of medium to be stacked on the tray, and the post-processing controller causes the driving mechanism to correct the rotational angle and the amount of rectilinear movement based on a signal sent from the third detector.

6. An image forming apparatus, comprising:

an image forming main device configured to form an image on the sheet of medium; and the post-processing device according to claim 1.

7. The post-processing device according to claim 1, wherein the alignment member support comprises a guide rail extending in the shift direction, the pair of alignment members moves along the guide rail in the shift direction, and the rotation shaft is configured to be movable with respect to the guide rail in the shift direction.

8. A post-processing device, comprising:

a pair of feed rollers configured to feed a sheet of medium in a feed direction while sandwiching the sheet of medium therebetween;

a tray configured to stack the sheet of medium fed by the pair of feed rollers in a stacking direction; and a sheet aligning mechanism configured to cause the sheet of medium stacked on the tray to move in a shift direction perpendicular to the feed direction and the stacking direction, such that the sheet of medium is aligned, wherein the sheet aligning mechanism comprises:

a pair of alignment members including a pair of alignment surfaces configured to push an end of the sheet of medium in the shift direction, the pair of alignment surfaces extending into a region above the tray in the stacking direction;

an alignment member support configured to support the pair of alignment members such that the pair of alignment members is rotatable about a rotation shaft extending in the shift direction and rectilinearly movable in the shift direction, within a region on a side closer to the sheet of medium stacked on the tray with respect to the stacking direction;

a driving mechanism configured to cause the pair of alignment members to rotate about the rotation shaft extending in the shift direction and to rectilinearly move in the shift direction;

a first detector configured to detect whether the pair of alignment members has moved to a rotational waiting position provided for the pair of alignment members, the rotational waiting position being a part of a rotational range in which the pair of alignment members is rotatable about the rotation shaft extending in the shift direction;

a second detector configured to detect whether the pair of alignment members has moved to a rectilinear waiting position provided for the pair of alignment members, the rectilinear waiting position being a part of a rectilinear range in which the pair of alignment members is movable in the shift direction;

a post-processing controller configured to cause the driving mechanism to correct a rotational angle and an amount of rectilinear movement based on signals sent from the first detector and the second detector; and a third detector configured to detect passage of the sheet of medium to be stacked on the tray, wherein the post-processing controller causes the driving mechanism to correct the rotational angle and the amount of rectilinear movement based on a signal sent from the third detector.

* * * * *